US008698290B2

(12) United States Patent
Masumoto et al.

(10) Patent No.: US 8,698,290 B2
(45) Date of Patent: Apr. 15, 2014

(54) LED LAMP

(75) Inventors: Tatsuya Masumoto, Kyoto (JP); Satoru Masaki, Kyoto (JP); Hironobu Kaneko, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 254 days.

(21) Appl. No.: 13/125,904

(22) PCT Filed: Nov. 6, 2009

(86) PCT No.: PCT/JP2009/068970

§ 371 (c)(1),
(2), (4) Date: Apr. 25, 2011

(87) PCT Pub. No.: WO2010/053147

PCT Pub. Date: May 14, 2010

(65) Prior Publication Data

US 2011/0204393 A1 Aug. 25, 2011

(30) Foreign Application Priority Data

Nov. 6, 2008 (JP) ..... 2008-285077
Oct. 19, 2009 (JP) ..... 2009-240893
Oct. 19, 2009 (JP) ..... 2009-240894

(51) Int. Cl.
*H01L 23/02* (2006.01)

(52) U.S. Cl.
USPC ..... 257/678; 257/685; 257/731; 257/784; 257/E51.021; 362/612; 362/613; 362/249; 362/800; 362/363

(58) Field of Classification Search
None
See application file for complete search history.

(56) References Cited

U.S. PATENT DOCUMENTS

| | | | | |
|---|---|---|---|---|
| 5,519,596 | A * | 5/1996 | Woolverton | 362/249.01 |
| 6,299,337 | B1 * | 10/2001 | Bachl et al. | 362/545 |
| 6,746,885 | B2 * | 6/2004 | Cao | 438/26 |
| 6,891,200 | B2 | 5/2005 | Nagai et al. | |
| 7,347,589 | B2 | 3/2008 | Ge | |
| 2003/0040200 | A1 * | 2/2003 | Cao | 438/800 |
| 2006/0193130 | A1 * | 8/2006 | Ishibashi | 362/227 |
| 2009/0268461 | A1 * | 10/2009 | Deak et al. | 362/247 |

FOREIGN PATENT DOCUMENTS

| | | | |
|---|---|---|---|
| CN | 2861726 | | 1/2007 |
| CN | 2918987 | | 7/2007 |
| CN | 201133600 | | 10/2008 |
| JP | 2001-52504 | | 2/2001 |
| JP | 2002-184209 | | 6/2002 |
| JP | 2002184209 | A * | 6/2002 |
| JP | 2003-168305 | | 6/2003 |
| JP | 2005-513815 | | 5/2005 |
| JP | 2006-244725 | | 9/2006 |
| JP | 3141579 | | 5/2008 |

* cited by examiner

*Primary Examiner* — Tan N Tran
*Assistant Examiner* — Scott R Wilson
(74) *Attorney, Agent, or Firm* — Hamre, Schumann, Mueller & Larson, P.C.

(57) ABSTRACT

An LED lamp (A1) includes a plurality of LEDs (2), a retainer (1) on which the light LEDs (2) are mounted, and a wiring pattern formed on the retainer (1) and electrically connected to the LEDs (2). The retainer (1) includes a plurality of substrates (11, 12, 15). Of the plurality of substrates (11, 12, 15), two adjacent substrates (11, 12) are connected to each other by a pair of bendable connection members (32*a*, 32*b*). The two substrates (11, 12) are arranged in such a manner that their normal line directions differ from each other.

17 Claims, 24 Drawing Sheets

LED LAMP

TECHNICAL FIELD

The present invention relates to an LED lamp that utilizes a light emitting diode (referred to as "LED" below) as the light source and that can be used as a substitute for an incandescent lamp or a fluorescent lamp.

FIG. 25 is a perspective view showing an example of conventional LED lamp (see Patent Document 1, for example). The LED lamp X shown in the figure includes a disk-like substrate 91, a plurality of LEDs 92 mounted on the disk-like substrate 91, and a base 93 connected to the substrate 91. The LED lamp X is structured such that the LEDs 92 can be turned on by mounting the base 93 to an existing light bulb socket designed for screwing-in a base of an incandescent lamp, for example.

In the LED lamp X, the LEDs 92 are mounted on a single, flat substrate 91, which configuration allows only a limited area to be illuminated. Hence, the LED lamp X, when used in place of an incandescent lamp, may unduly leave a corner of the room badly lit.

Patent Document 1: JP-A-2001-052504

DISCLOSURE OF THE INVENTION

Problems to be Solved by the Invention

The present invention has been proposed under the circumstances described above. It is therefore an object of the present invention to provide an LED lamp that is capable of illuminating a wider area.

Means for Solving the Problems

An LED lamp provided according to the present invention comprises a plurality of light emitting diodes, a retainer on which the light emitting diodes are mounted, and a wiring pattern formed on the retainer and electrically connected to the light emitting diodes. The retainer includes two mount surfaces that are adjacent to each other via a bent portion, and normal line directions of the two mount surfaces are oriented in different directions from each other.

In a preferred embodiment of the present invention, the LED lamp further comprises a support including a plurality of attachment surfaces whose normal line directions are different from each other. The retainer is attached to the support in such a manner that each of the two mount surfaces overlaps a respective one of the attachment surfaces.

Preferably, the attachment surfaces include a central attachment surface that overlaps one of the two mount surfaces. The support has a shape projecting in the normal line direction of the central attachment surface. The support includes a side surface that surrounds the central attachment surface as viewed in the normal line direction of the central attachment surface. Of the plurality of attachment surfaces, the attachment surface that overlaps the other one of the two mount surfaces is provided on the side surface.

More preferably, as the side surface proceeds away from the central attachment surface in the normal line direction of the central attachment surface, the side surface proceeds away from the central attachment surface in a direction perpendicular to the normal line direction of the central attachment surface.

More preferably, the central attachment surface is rectangular, and the side surface comprises a plurality of peripheral attachment surfaces that adjoin sides of the central attachment surface, respectively.

More preferably, the retainer comprises a plurality of separate substrates. The two mount surfaces are obverse surfaces of adjacent two of the plurality of substrates. The bent portion comprises a pair of bendable connection members connecting the two adjacent substrates. The paired connection members electrically connect the wiring patterns formed on the two substrates to each other.

In a preferred embodiment of the present invention, the retainer comprises a rectangular central substrate and a plurality of peripheral substrates separate from the central substrate and surrounding the central substrate. One of the two mount surfaces is an obverse surface of the central substrate, whereas the other one of the two mount surfaces is an obverse surface of the peripheral substrates. The bent portion comprises a pair of bendable connection members connecting the central substrate and each of the peripheral substrates. The paired connection members electrically connect the wiring pattern formed on the central substrate and the wiring pattern formed on the peripheral substrates to each other. The central substrate is attached to the central attachment surface, whereas the peripheral substrates are attached to the peripheral attachment surfaces.

In a preferred embodiment of the present invention, the retainer comprises a flexible wiring substrate. The two mount surfaces are part of an obverse surface of the flexible wiring substrate. The bent portion is formed by bending the flexible wiring substrate.

In a preferred embodiment of the present invention, the retainer comprises a flexible wiring substrate including a rectangular central mount surface that is one of the two mount surfaces and a plurality of peripheral mount surfaces that are the other one of the two mount surfaces and that surround the central mount surface. The bent portion is formed by bending between the peripheral mount surfaces and the central mount surface. The retainer is attached to the support in such a manner that the central mount surface is supported by the central attachment surface and the peripheral mount surfaces are supported by the peripheral attachment surfaces.

In another preferred embodiment of the present invention, the support is in the form of a frustum whose top surface is the central attachment surface. The retainer comprises a flexible wiring substrate including a disk-like central mount surface and a side mount surface surrounding the central mount surface. The bent portion is formed by bending a connection portion between the central mount surface and the side mount surface. The central mount surface and the central attachment surface overlap each other, whereas the side mount surface and the side surface overlap each other.

Preferably, the support is provided with a base for supplying electric power to the light emitting diodes, on an opposite side of the central attachment surface in the normal line direction of the central attachment surface.

Preferably, the support includes a reflective surface provided around the attachment surfaces.

More preferably, the support includes a columnar portion extending between the attachment surfaces and the reflective surface in a direction perpendicular to the reflective surface.

In a preferred embodiment of the present invention, the LED lamp further comprises a globe that includes an opening and houses the light emitting diodes.

More preferably, the inner surface of the globe includes a portion where a radius of curvature reduces as proceeding away from the opening.

More preferably, the globe includes a cylindrical portion and a dome portion connected to the cylindrical portion.

More preferably, the cylindrical portion is tapered.

In a preferred embodiment of the present invention, the LED lamp further comprises a globe that includes an opening and houses the light emitting diodes. The support is in the form of a frustum including a top surface positioned on an opposite side of the opening of the globe and one or a plurality of side surfaces surrounding the top surface. The globe includes an inner surface inclined in the same direction as a direction in which the one or a plurality of side surfaces adjacent thereto are inclined with respect to the top surface.

In another preferred embodiment of the present invention, the LED lamp includes a plurality of light emitting diodes, a foundation portion supporting the light emitting diodes, and a globe that includes an outer surface flush with an outer surface of the foundation portion and allows light emitted from the light emitting diodes to pass through.

In a preferred embodiment of the present invention, the LED lamp further comprises a retainer including a first surface on which at least any one of the light emitting diodes is mounted and a second surface which is oriented in a different direction from the first surface and on which at least any one of the light emitting diodes are mounted. The globe houses the light emitting diodes.

In a preferred embodiment of the present invention, the inner surface of the globe includes a portion where a radius of curvature reduces as proceeding away from the foundation portion.

In a preferred embodiment of the present invention, the globe includes a cylindrical portion including an outer surface that is flush with an outer surface of the foundation portion, and a dome portion connected to the cylindrical portion.

Preferably, the cylindrical portion is tapered.

More preferably, the outer surface of the foundation portion is smooth.

More preferably, the outer surface of the foundation portion is formed with minute irregularities.

In a preferred embodiment of the present invention, current flowing through the light emitting diodes is 20 to 25 mA.

In a preferred embodiment of the present invention, the LED lamp further comprises a support including a plurality of attachment surfaces oriented in different directions. The retainer is attached to the support in such a manner that each of the first and the second surfaces overlaps a respective one of the attachment surfaces.

In a preferred embodiment of the present invention, the retainer comprises a flexible wiring substrate. The first and the second surfaces comprise part of the obverse surface of the flexible substrate. The retainer is placed on the support, with the flexible wiring substrate bent.

BEST MODE FOR CARRYING OUT THE INVENTION

Preferred embodiments of the present invention are described below with reference to the accompanying drawings.

Figure 1:
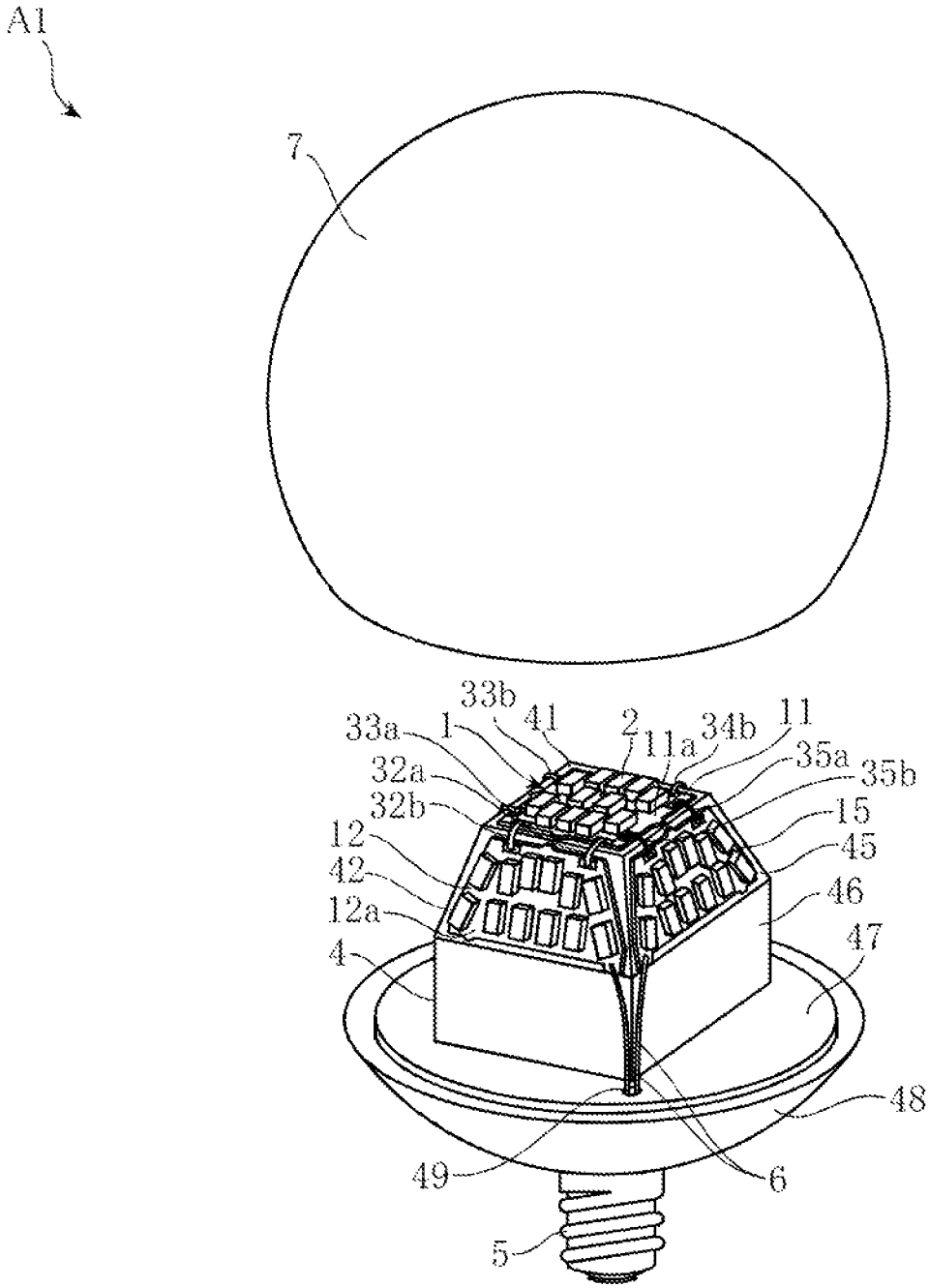
FIG. 1 is a perspective view showing an LED lamp according to a first embodiment of the present invention.
Figure 2:
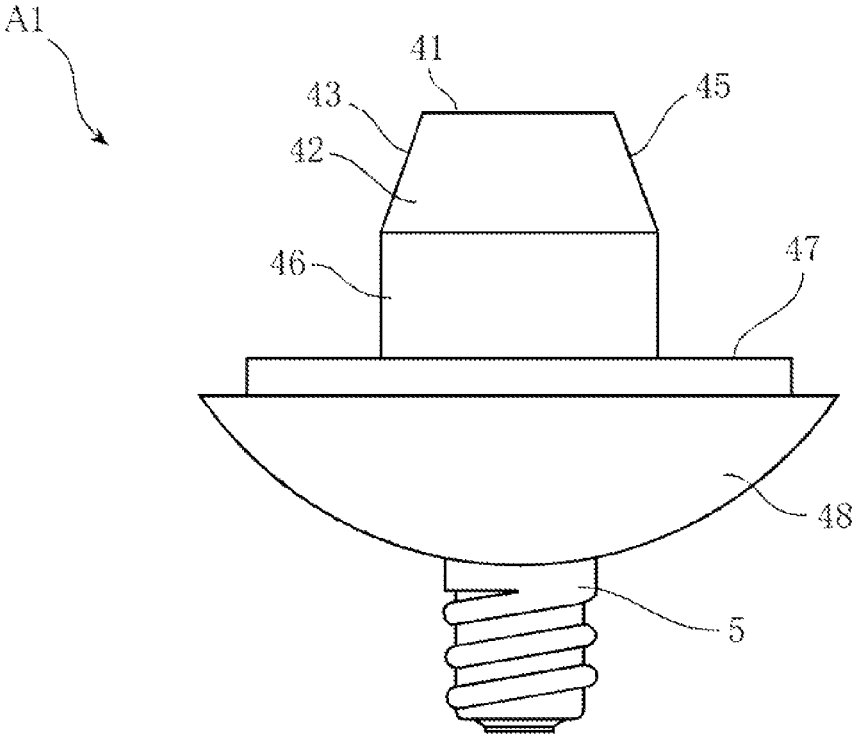
FIG. 2 is a front view showing part of the LED lamp shown in FIG. 1.
Figure 3:
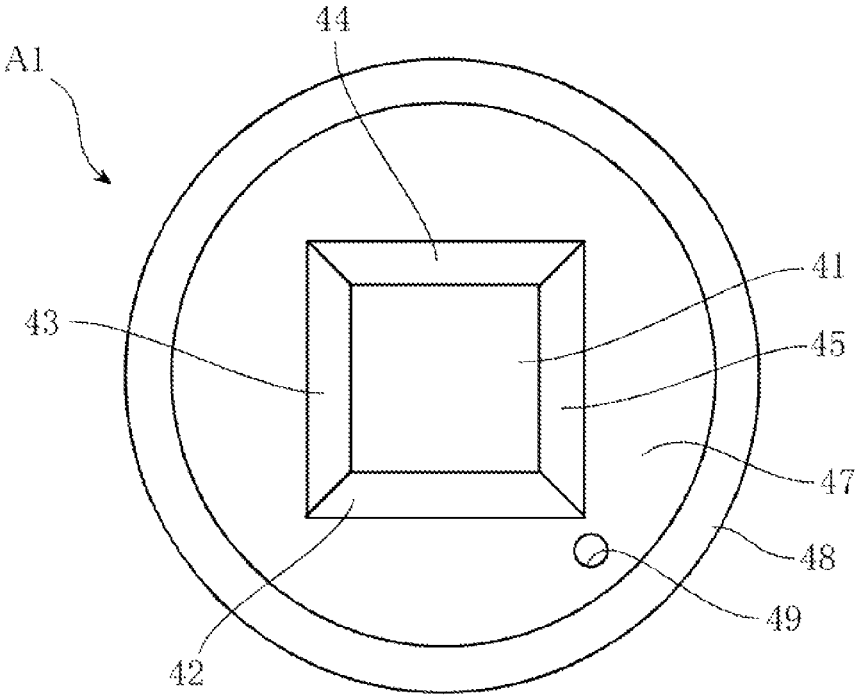
FIG. 3 is a plan view showing part of the LED lamp shown in FIG. 1.
Figure 4:
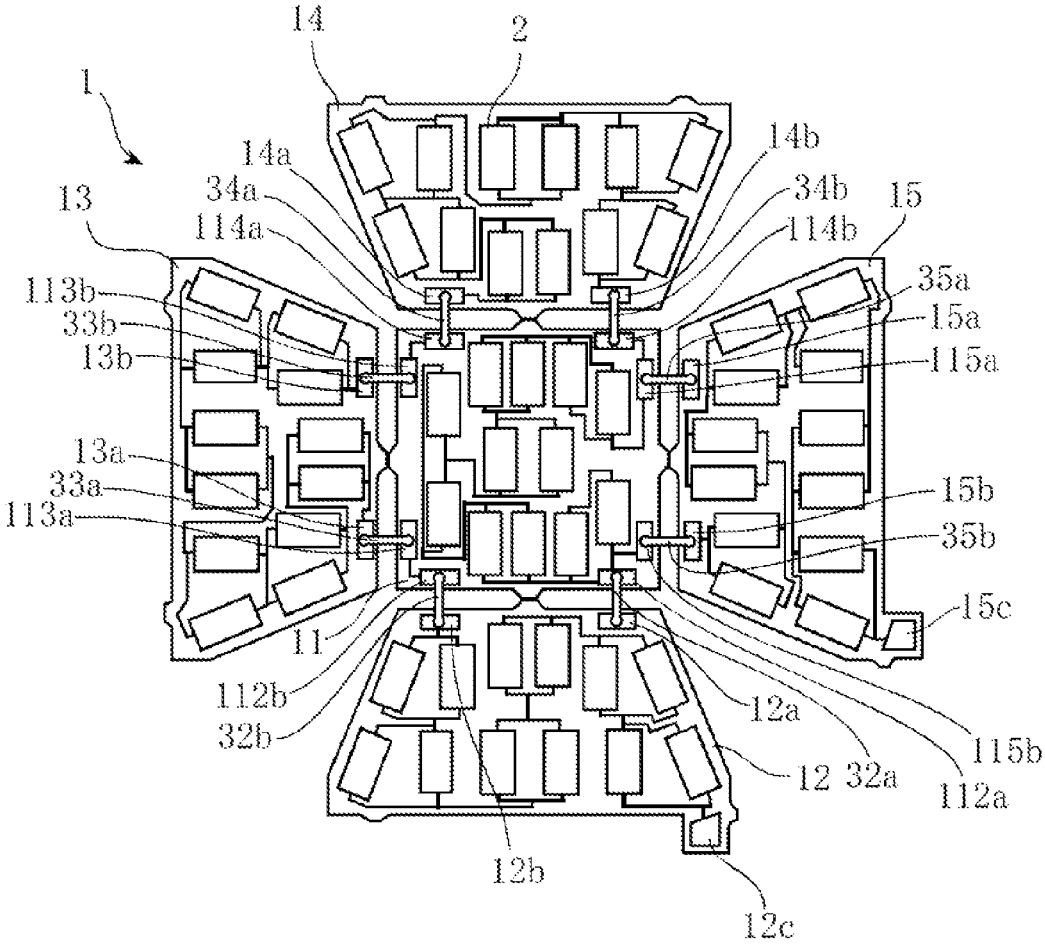
FIG. 4 is a plan view showing a retainer for attachment to the LED lamp shown in FIG. 1.
Figure 5:
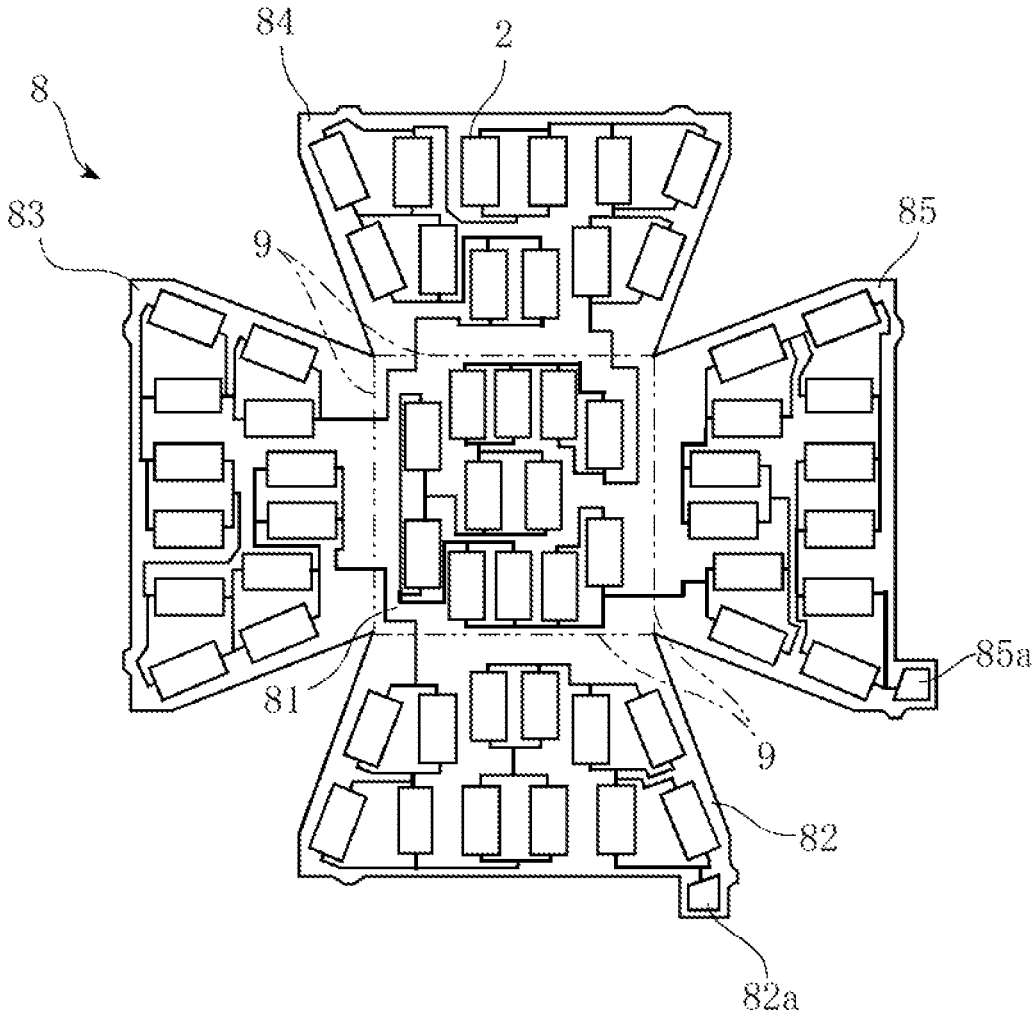
FIG. 5 is a plan view of a flexible wiring substrate for attachment to an LED lamp according to a second embodiment of the present invention.

FIG. 1 shows an LED lamp according to a first embodiment of the present invention. The LED lamp A1 shown in FIG. 1 includes a retainer 1, sixty LED modules 2 mounted on the retainer 1, four pairs of connection members 32*a*, 32*b*, 33*a*, 33*b*, 34*a*, 34*b*, 35*a*, 35*b*, a support 4, a base 5, two wirings 6 and a cover 7. FIG. 2 is a front view of the support 4. FIG. 3 is a plan view of the support 4, as seen from above in FIG. 1. FIG. 4 is a plan view of the retainer 1 in the state before it is attached to the support 4. The base 5 of the LED lamp A1 is attachable to an existing screw-type bulb socket so that the LED lamp A1 can be used as a substitute for an incandescent lamp.

The retainer 1 comprises a central substrate 11 and four peripheral substrates 12, 13, 14, 15 which are spaced apart from each other. As shown in FIG. 4, the retainer is formed with wiring patterns on the surface. The retainer 1 is further provided with a white protective layer (not shown) covering the wiring patterns. The central substrate 11 and four peripheral substrates 12, 13, 14, 15, which constitute the retainer 1, are formed by cutting out of a single large plate-like substrate made of e.g. glass-fiber-reinforced epoxy resin.

Each LED module 2 incorporates an LED that may have a laminated structure made up of an n-type semiconductor layer, a p-type semiconductor layer, and an active layer sandwiched between these layers. The LED modules are incorporated in the wiring patterns on the retainer 1 to emit light.

As shown in FIG. 4, the central substrate 11 is rectangular in plan view and includes eight electrode pads 112*a*, 112*b*, 113*a*, 113*b*, 114*a*, 114*b*, 115*a*, 115*b*. The electrode pads 112*a* and 115*b* are electrically connected to each other, so are the electrode pads 112*b* and 113*a*, the electrode pads 113*b* and 114*a*, the electrode pads 114*b* and 115*a*. The central substrate 11 has a mount surface 11*a* on the obverse side, and twelve LED modules 2 are mounted on the mount surface 11*a*. The wiring pattern on the central substrate 11 connects the electrode pad 114*b*, the twelve LED modules 2 and the electrode pad 115*b*. Specifically, this wiring pattern connects six pairs of parallel-connected LED modules 2 in series.

As shown in FIG. 4, the peripheral substrate 12 has a trapezoidal shape in plan view and is provided with three electrode pads 12*a*, 12*b*, 12*c*. The peripheral substrate has a mount surface 12*a* on the obverse side, on which twelve LED modules 2 are mounted. The electrode pads 12*a* and 12*b* are arranged along a side that is closer to the central substrate 11. The electrode pad 12*c* is arranged at an end of a side that is farther from the central substrate 11. The wiring pattern on the peripheral substrate 12 connects the electrode pad 12*c*, the twelve LED modules 2 and the electrode pad 12*b*. Specifically, this wiring pattern connects six pairs of parallel-connected LED modules 2 in series. The electrode pad 12*a* is connected to the electrode pad 112*a* of the central substrate 11 via the connection means 32*a*. The electrode pad 12*b* is electrically connected to the electrode pad 112*b* of the central substrate 11 via the connection means 32*b*. One of the wirings 6 is connected to the electrode pad 12*c*.

As shown in FIG. 4, the peripheral substrate 13 has a trapezoidal shape in plan view and is provided with two electrode pads 13*a* and 13*b*. The peripheral substrate has a mount surface on the obverse side, on which twelve LED modules 2 are mounted. The electrode pads 13*a* and 13*b* are arranged along a side that is closer to the central substrate 11. The wiring pattern on the peripheral substrate 13 connects the electrode pad 13*a*, the twelve LED modules 2 and the electrode pad 13*b*. Specifically, this wiring pattern connects six pairs of parallel-connected LED modules 2 in series. The electrode pad 13*a* is electrically connected to the electrode pad 113*a* of the central substrate 11 via the connection means 33*a*. The electrode pad 13*b* is electrically connected to the electrode pad 113*b* of the central substrate 11 via the connection means 33*b*.

As shown in FIG. 4, the peripheral substrate 14 has a trapezoidal shape in plan view and is provided with two electrode pads 14*a* and 14*b*. The peripheral substrate has a mount surface on the obverse side, on which twelve LED modules 2 are mounted. The electrode pads 14*a* and 14*b* are arranged along a side that is closer to the central substrate 11. The wiring pattern on the peripheral substrate 14 connects the electrode pad 14*a*, the twelve LED modules 2 and the electrode pad 14*b*. Specifically, this wiring pattern connects six pairs of parallel-connected LED modules 2 in series. The electrode pad 19*a* is electrically connected to the electrode pad 114*a* of the central substrate 11 via the connection means 34*a*. The electrode pad 14*b* is electrically connected to the electrode pad 114*b* of the central substrate 11 via the connection means 34*b*.

As shown in FIG. 4, the peripheral substrate 15 has a trapezoidal shape in plan view and is provided with three electrode pads 15*a*, 15*b*, 15*c*. The peripheral substrate has a mount surface on the obverse side, on which twelve LED modules 2 are mounted. The electrode pads 15*a* and 15*b* are arranged along a side that is closer to the central substrate 11. The electrode pad 15*c* is arranged at an end of a side that is farther from the central substrate 11. The wiring pattern on the peripheral substrate 15 connects the electrode pad 15*b*, the twelve LED modules 2 and the electrode pad 15*c*. Specifically, this wiring pattern connects six pairs of two parallel-connected LED modules 2 in series. The electrode pad 15*a* is connected to the electrode pad 115*a* of the central substrate 11 via the connection means 35*a*. The electrode pad 15*b* is electrically connected to the electrode pad 115*b* of the central substrate 11 via the connection means 35*b*. The other one of the wirings 6 is connected to the electrode pad 15*c*.

The connection means 32*a*, 32*b*, 33*a*, 33*b*, 34*a*, 34*b*, 35*a*, 35*b* are made of e.g. solder mainly composed of Sn, Ag and Cu and bendable. The pair of connection means 32*a* and 32*b* connect the central substrate 11 and the peripheral substrate 12. The pair of connection means 33*a* and 33*b* connect the central substrate 11 and the peripheral substrate 13. The pair of connection means 34*a* and 34*b* connect the central substrate 11 and the peripheral substrate 14. The pair of connection means 35*a* and 35*b* connect the central substrate 11 and the peripheral substrate 15.

The support 4 is made of e.g. A1 and includes a central attachment surface 41, peripheral attachment surfaces 42, 43, 44, 45, a prism portion 46, a reflective surface 47 and an outer casing 48. To the lower end of the support 4 is mounted the base 5. The reflective surface 47 and the outer casing 48 are formed with a through-hole 49 for guiding the two wirings 6 to the base 5.

As shown in FIGS. 1 and 2, the central attachment surface 41 is rectangular and provided at the upper end of the support 4. The normal line direction of the central attachment surface 41 is the vertically upward direction in FIGS. 1 and 2. As shown in FIGS. 1 and 2, all the peripheral attachment surfaces 15, 42, 43, 44, 45 are inclined with respect to the central attachment surface 41. As shown in FIG. 3, the peripheral attachment surfaces 42, 43, 44, 45 adjoin the four sides of the central attachment surface 41 and surround the central attachment surface. Each peripheral attachment surfaces 42, 43, 44, 45 has a trapezoidal shape whose upper side is shorter and lower side is longer. Adjacent ones of the peripheral attachment surfaces 42, 43, 44, 45 have a common side. The respective normal line directions of the peripheral attachment surfaces 42, 43, 44, 45 are inclined with respect to the vertically upward direction and oriented in different directions from each other. The peripheral attachment surfaces 42 and 44 extend away from each other as proceeding downward, and also, the peripheral attachment surfaces 43 and 45 extend away from each other as proceeding downward.

The central substrate 11 is attached to the central attachment surface 41 by using e.g. a double-sided adhesive tape. The peripheral substrates 12, 13, 14, 15 are attached to the peripheral attachment surfaces 42, 43, 44, 45 by similarly using a double-sided adhesive tape, for example. Since the normal line directions of the central attachment surface 41 and the peripheral attachment surfaces 42, 43, 44, 45 are different from each other, the normal line directions of the central substrate 11 and the peripheral substrates 12, 13, 14, 15, which are attached to these attachment surfaces, are also different from each other. Because of the inclination of the peripheral attachment surfaces 42, 43, 44, 45, more light from the LED modules 2 mounted on the peripheral substrates 12, 13, 14, 15 is emitted upward than downward in the vertical direction.

The prism portion 46 connects the lower sides of the peripheral attachment surfaces 42, 43, 44, 45 and the reflective surface 47. As shown in FIG. 3, the reflective surface 47 is circular in plan view. The reflective surface 47 is provided for reflecting the light from the LED modules 2 upward.

The outer casing 48 has an outer surface that is painted white, and is designed to provide an appearance similar to that of an existing white light bulb when a cover 7 is attached to the outer casing.

One of the wirings 6 connected to the base 5 is connected to the electrode pad 12*c*. The wiring pattern on the peripheral substrate 12 connects the electrode pad 12*c* and the electrode pad 12*b*. The electrode pad 12*b* is electrically connected to the electrode pad 13*a* via the electrode pads 112*b*, 113*a* and two connection means 32*b*, 33*a*. The wiring pattern on the peripheral substrate 13 connects the electrode pad 13*a* and the electrode pad 13*b*. The electrode pad 13*b* is electrically connected to the electrode pad 14*a* via the electrode pads 113*b*, 114*a* and two connection means 33*b*, 34*a*. The wiring pattern on the peripheral substrate 14 connects the electrode pad 14*a* and the electrode pad 14*b*. The electrode pad 14*b* is electrically connected to the electrode pad 114*b* via the connection means 34*b*. The wiring pattern on the central substrate 11 connects the electrode pad 114*b* and the electrode pad 115*b*. The electrode pad 115*b* is electrically connected to the electrode pad 15*b* via the connection means 35*b*. The wiring pattern on the peripheral substrate 15 connects the electrode pad 15*b* and the electrode pad 15*c*. The electrode pad 15*c* is connected to the other one of the wirings 6 connected to the base 5. With this arrangement, in the LED lamp A1, thirty pairs of parallel-connected LED modules 2 are arranged in series between the two wirings 6. Thus, by mounting the base 5 to a socket for a light bulb, all the sixty LED modules 2 can be turned on.

The advantages of the LED lamp A1 are described below.

According to the present embodiment, since the normal line directions of the central substrate 11 and the peripheral substrates 12, 13, 14, 15 are different from each other, the directions of light emission from the LED module 2 mounted on the central substrate 11 and the peripheral substrates 12, 13, 14, 15 are different from each other. Thus, the LED lamp A1 illuminates a wider area.

According to the present embodiment, the brightness equivalent to a conventional 40 W incandescent lamp can be achieved at a power consumption of 8 W. Further, since the LED lamp A1 is attachable to an existing socket for light bulbs, it can be readily used as a substitute for an incandescent lamp. The use of the LED lamp A1 instead of an incandescent lamp achieves significant energy saving.

According to the present embodiment, before the retainer 1 is attached to the support 4, whether or not the sixty LED modules 2 can be properly turned on can be checked by bringing test electrodes into contact with the electrode pads 12*c* and 15*c*. Thus, connection failure in the retainer 1 can be found before the retainer 1 is attached to the support 4, which reduces waste in the manufacturing process. Thus, the LED lamp A1 reduces the manufacturing cost.

According to the present embodiment, the LED modules 2 mounted on the central substrate 11 and the peripheral substrates 12, 13, 14, 15 emit light mainly upward. Thus, blocking of light by the outer casing 48 and the resulting failure of light emission to the outside is unlikely to occur, which is desirable for increasing the amount of light emission from the LED lamp 2.

According to the present embodiment, of the light emitted from the LED modules 2, part of the light traveling downward is reflected upward by the reflective surface 47. This is desirable for increasing the brightness of the LED lamp A1.

According to the present embodiment, the central attachment surface 41 and the peripheral attachment surfaces 42, 43, 44, 45 are spaced apart from the reflective surface 47 and the base 5 due to the presence of the prism portion 46. Thus, part of the light emitted from the LED modules 2 readily passes through the outside of the reflective surface 47 to travel downward of the LED lamp A1. This is desirable for increasing the illumination area of the LED lamp A1.

According to the present embodiment, the retainer 1 is cut out of a single large plate-like substrate, which is desirable for enhancing the productivity of the LED lamp A1.

An LED lamp according to a second embodiment of the present invention is described below. This LED lamp employs a flexible wiring substrate 8 shown in FIG. 4, instead of the retainer 1 of the LED lamp A1. The structures of other parts are the same as those of the foregoing LED lamp, and the illustration and description of these are omitted. The flexible wiring substrate 8 shown in FIG. 4 includes a central mount surface 81 and four peripheral mount surfaces 82, 83, 84, 85, on which sixty LED modules 2 are mounted. As shown in FIG. 4, the wiring pattern on the flexible wiring substrate 8 is designed such that thirty pairs of parallel-connected LED modules 2 are arranged in series between the electrode pad 82*a* and the electrode pad 82*b*. The flexible wiring substrate 8 is designed to be attached to the support 4 by bending at a bent portion 9 between the central mount surface 81 and each of the peripheral mount surfaces 82, 83, 84, 85. Specifically, the central mount surface 81 is attached to the central attachment surface 41, and the peripheral mount surfaces 82, 83, 84, 85 are attached to the peripheral attachment surfaces 42, 43, 44, 45.

The use of the flexible wiring substrate 8 also provides an LED lamp that is capable of illuminating a wide area, similarly to the LED lamp using the retainer 1. Unlike the retainer 1, the flexible wiring substrate 8 does not need to use a connection member, so that the manufacturing process is simplified.

Figure 6:
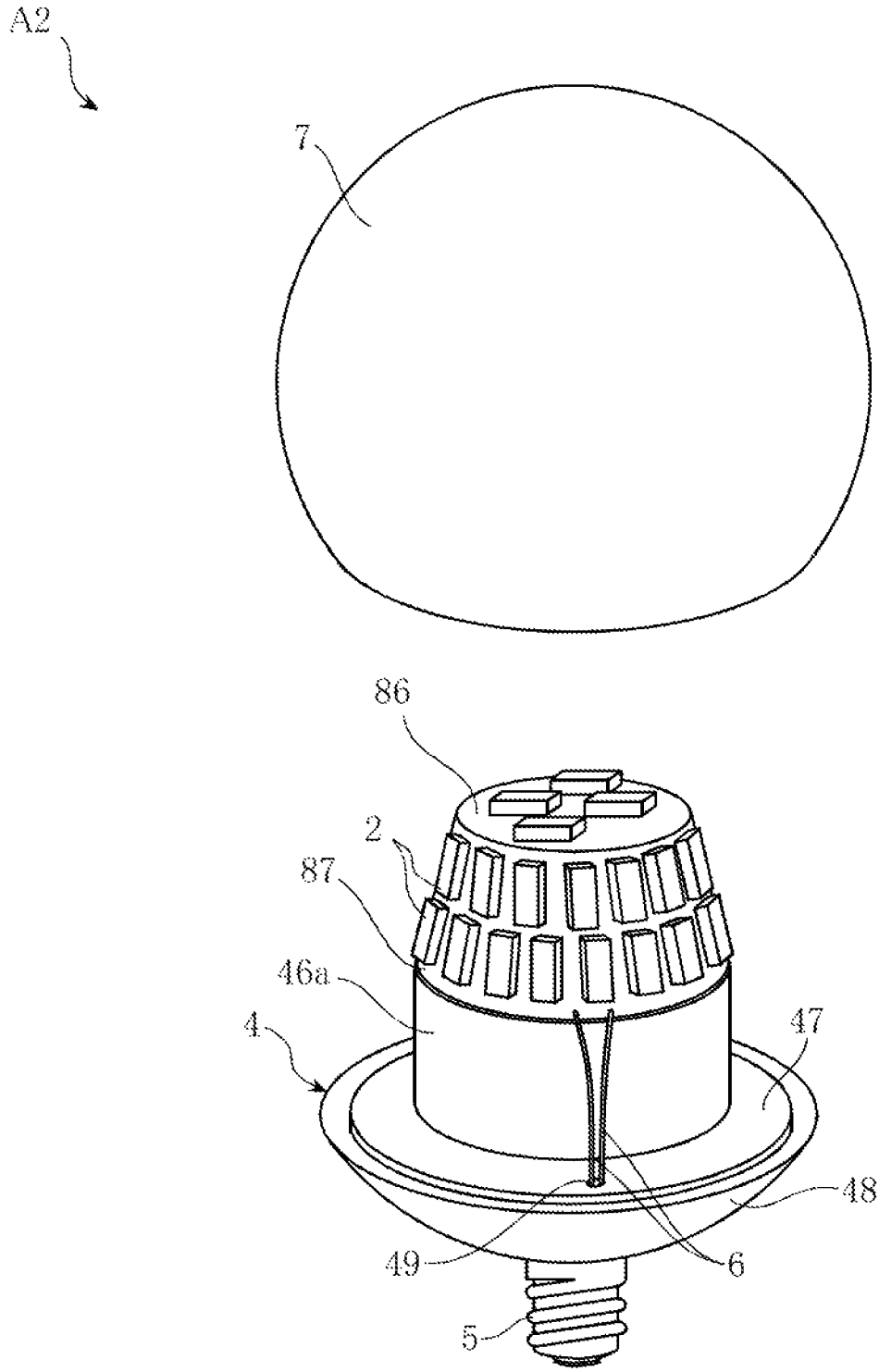
FIG. 6 is a perspective view showing an LED lamp according to a third embodiment of the present invention.
Figure 7:
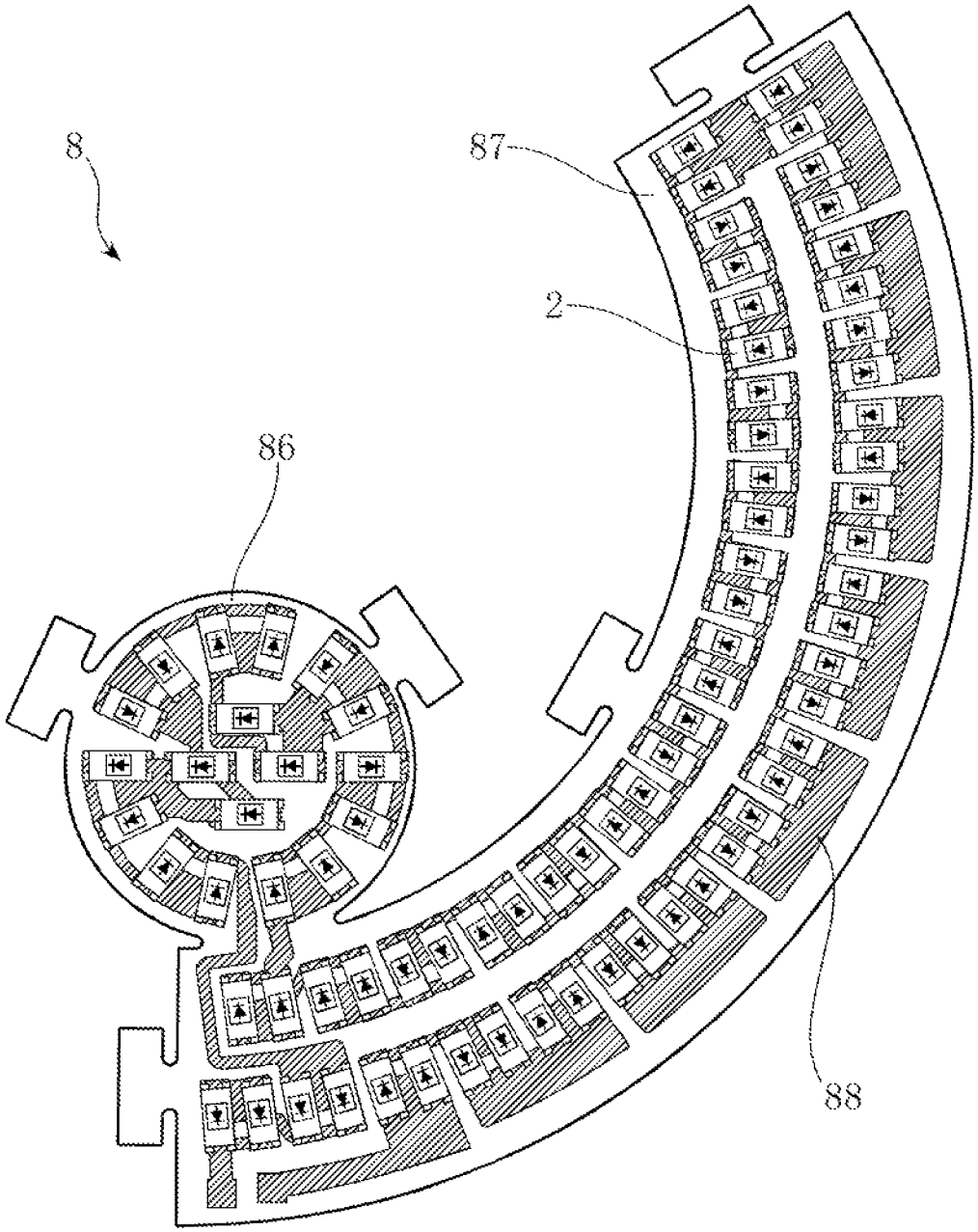
FIG. 7 is a plan view showing a flexible wiring substrate used for the LED lamp shown in FIG. 6.
Figure 8:
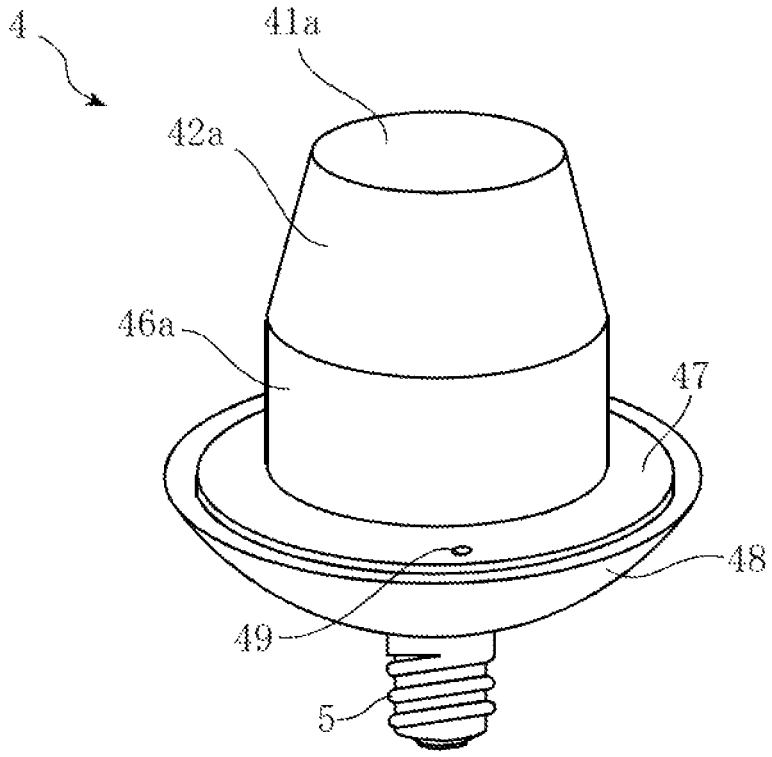
FIG. 8 is a perspective view showing a support used for the LED lamp shown in FIG. 6.

An LED lamp according to a third embodiment of the present invention is described below with reference to FIGS. 6-8. The LED lamp A2 shown in FIG. 6 employs the flexible wiring substrate 8 shown in FIG. 6 instead of the retainer 1 of the LED lamp A1 and also employs a support 4 shown in FIG. 7. The structures of other parts are the same as those of the LED lamp A1. In FIGS. 6-8, the elements that are identical or similar to those of the LED lamp A1 are designated by the same reference signs as those used for the LED lamp A1, and the description is appropriately omitted. The support 4 shown in FIG. 8 comprises a cylindrical portion 46*a*, which is employed instead of the prism portion 46, and a frustum portion placed on the cylindrical portion 46*a*. The support 4 further includes a top surface 41*a* and a side surface 42*a* of the frustum portion.

As shown in FIG. 7, the flexible wiring substrate 8 of this embodiment includes a central mount surface 86, a side mount surface 87 and a wiring pattern 88. The flexible wiring substrate 8 is attached to the support 4 such that the central mount surface 86 overlaps the top surface 41*a* and the side mount surface 87 overlaps the side surface 92*a*. At that time, the connecting portion between the central mount surface 86 and the side mount surface 87 is bent to become a bent portion. The wiring pattern 88 is designed to electrically connect the LED modules 2 to each other. In FIG. 6, the illustration of the wiring pattern 88 and some of the LED modules 2 is omitted.

The use of this flexible wiring substrate 8 also allows the LED lamp to illuminate a wide area, similarly to an LED lamp using the retainer 1. Unlike the retainer 1, the flexible wiring substrate 8 does not need to use a connection member, so that the manufacturing process is simplified.

Figure 9:
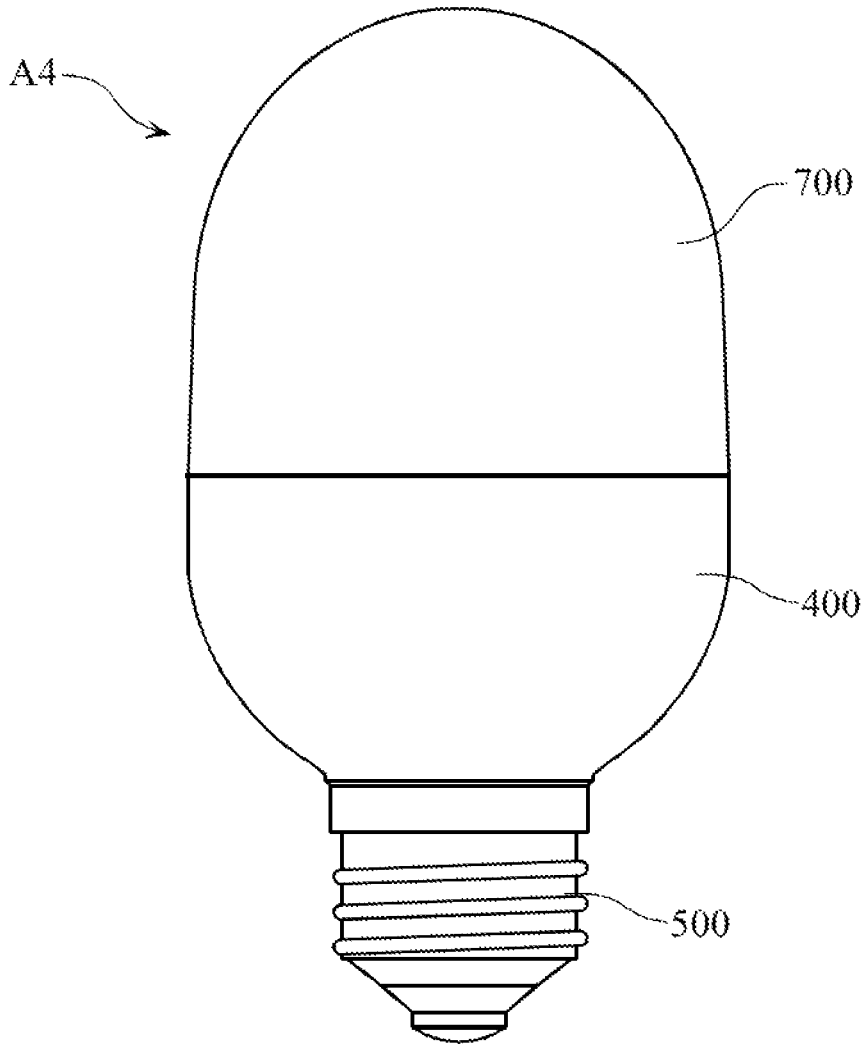
FIG. 9 is a front view of an LED lamp according to a fourth embodiment of the present invention.
Figure 10:
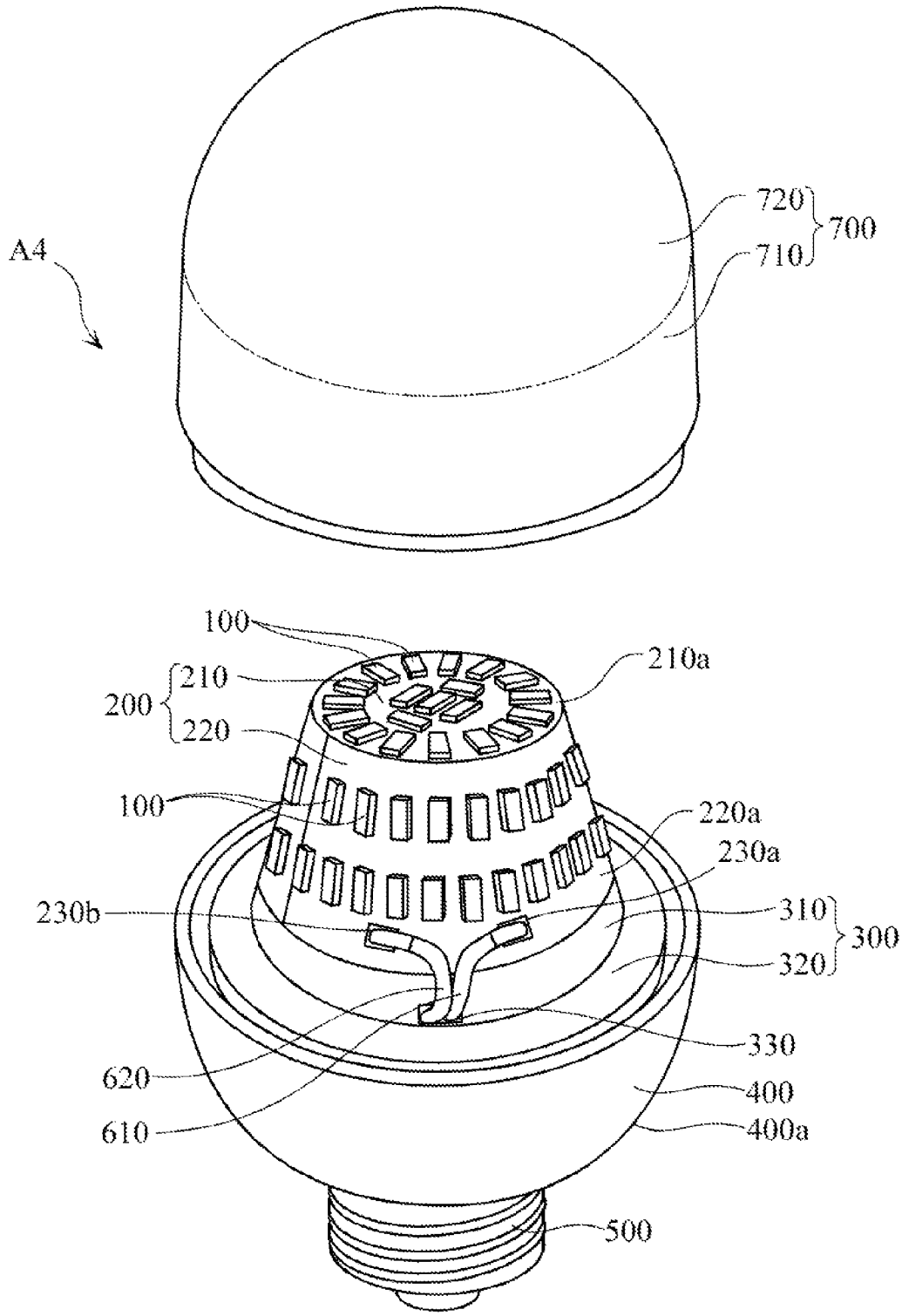
FIG. 10 is an exploded perspective view of the LED lamp shown in FIG. 9.
Figure 11:
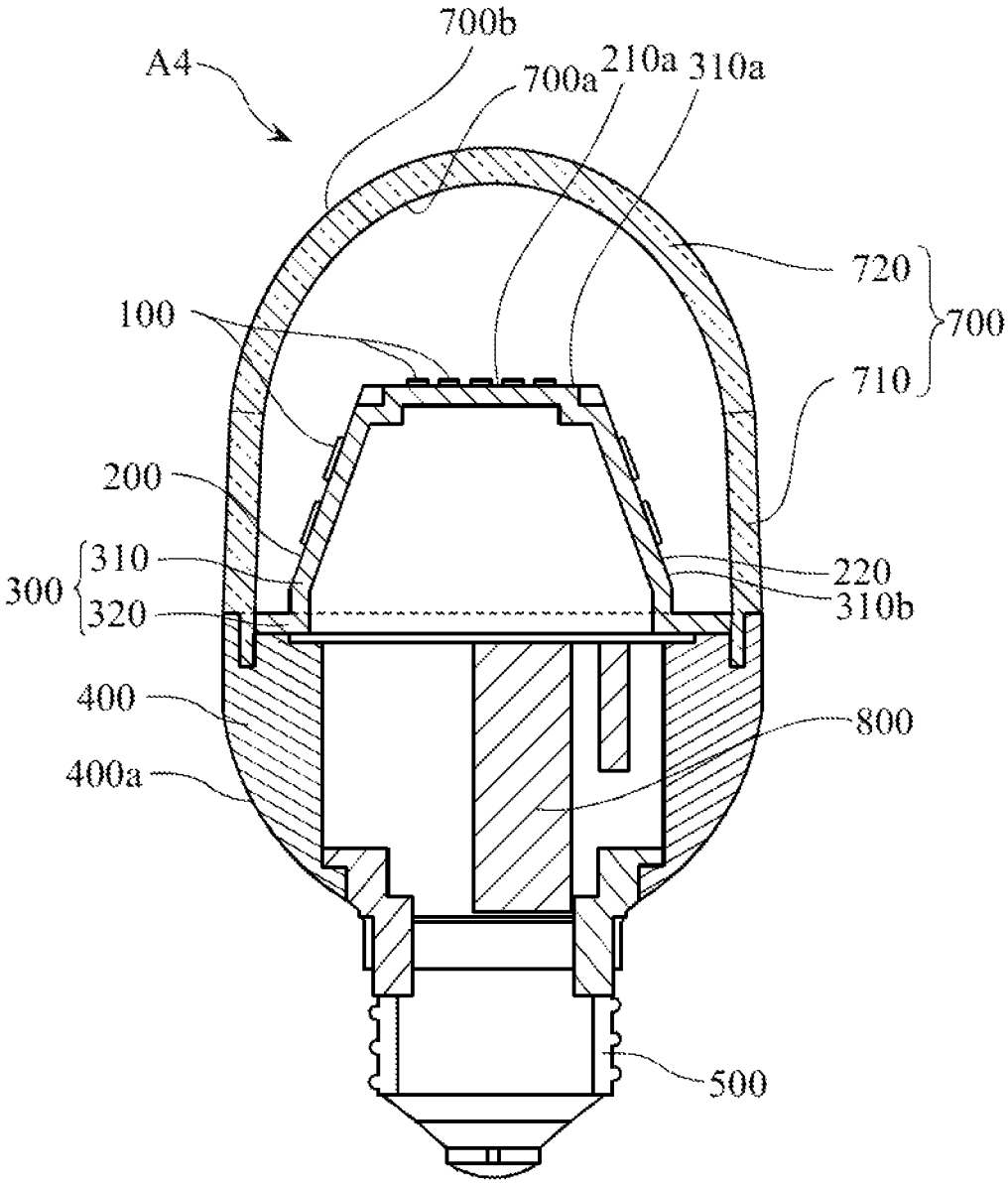
FIG. 11 is a sectional view of the LED lamp shown in FIG. 9.
Figure 12:
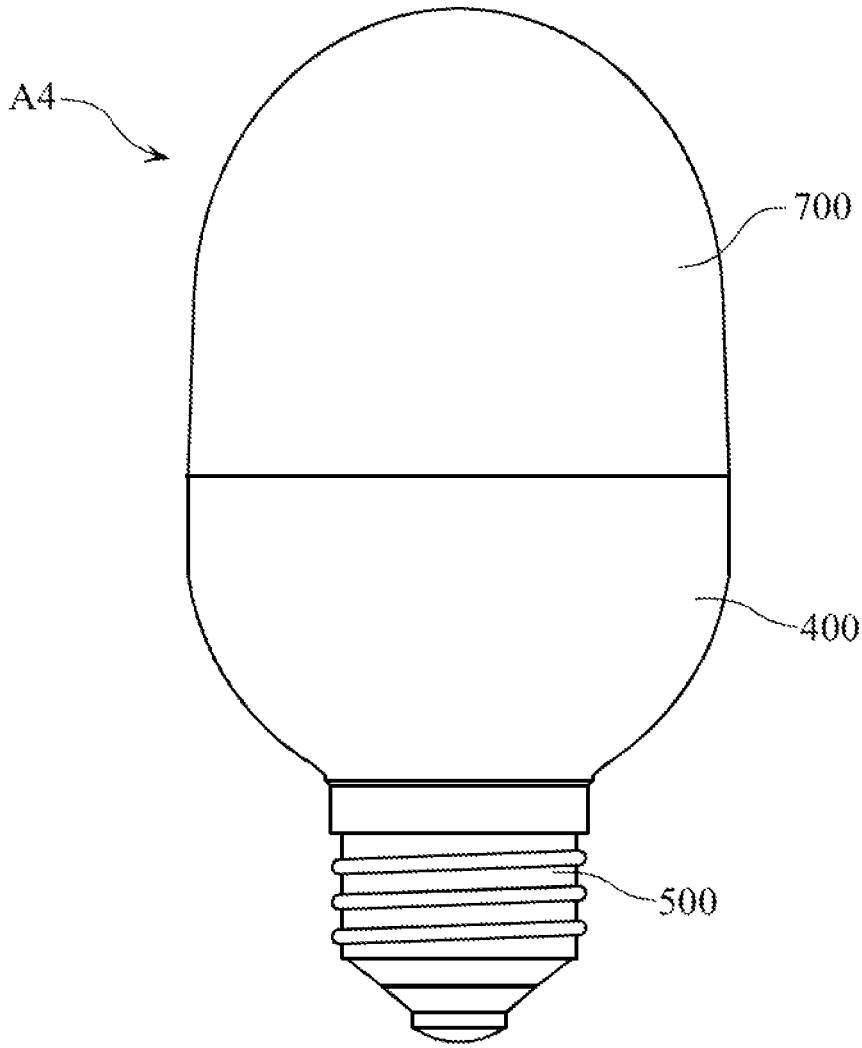
FIG. 12 is a right side view of the LED lamp shown in FIG. 9.
Figure 13:
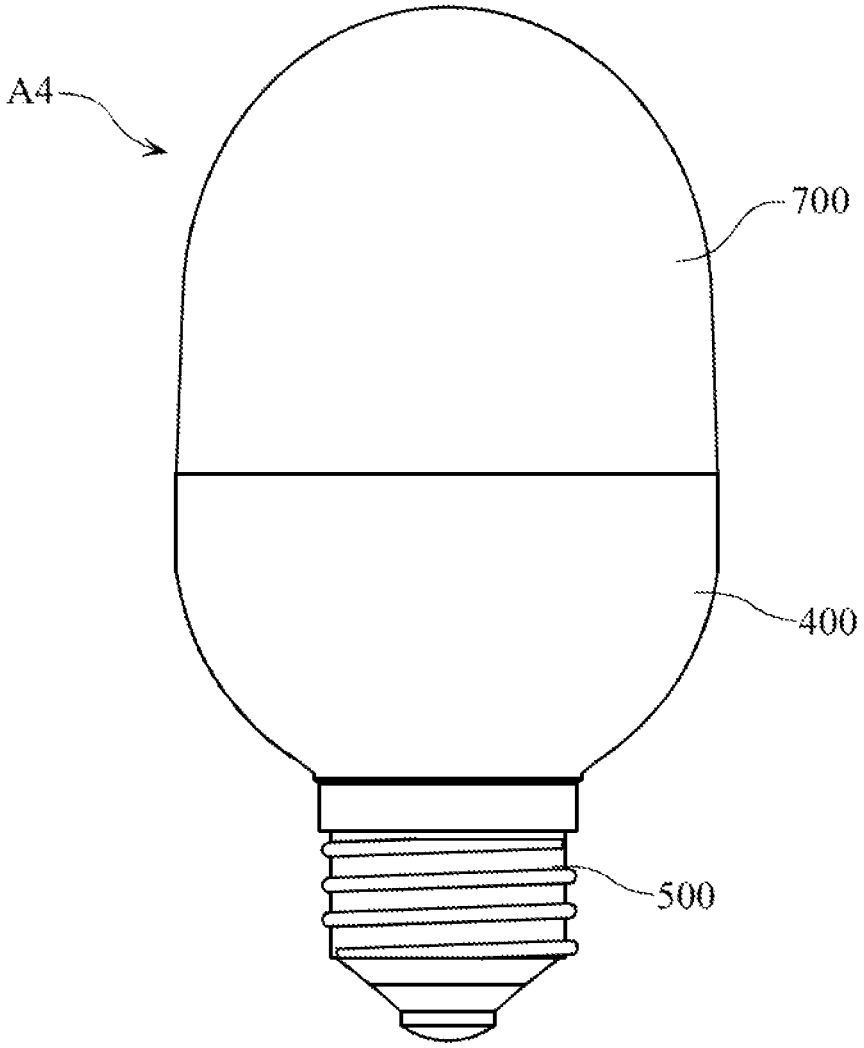
FIG. 13 is a left side view of the LED lamp shown in FIG. 9.
Figure 14:
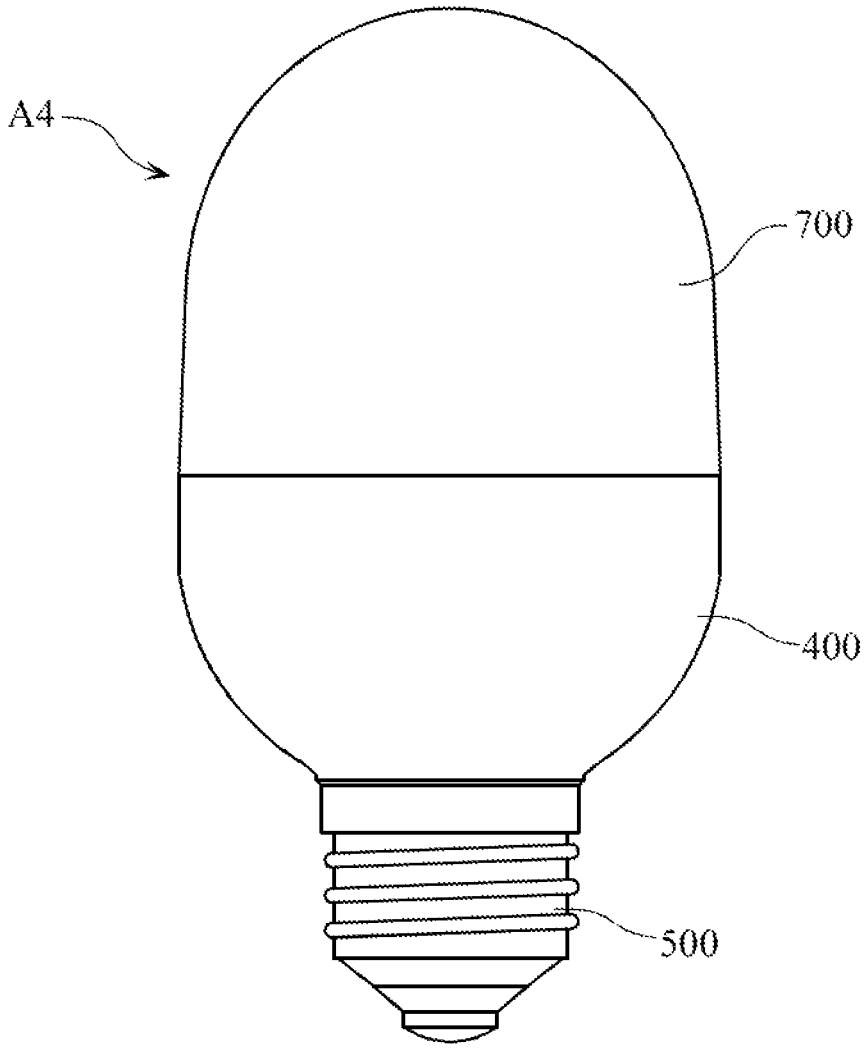
FIG. 14 is a rear view of the LED lamp shown in FIG. 9.
Figure 15:
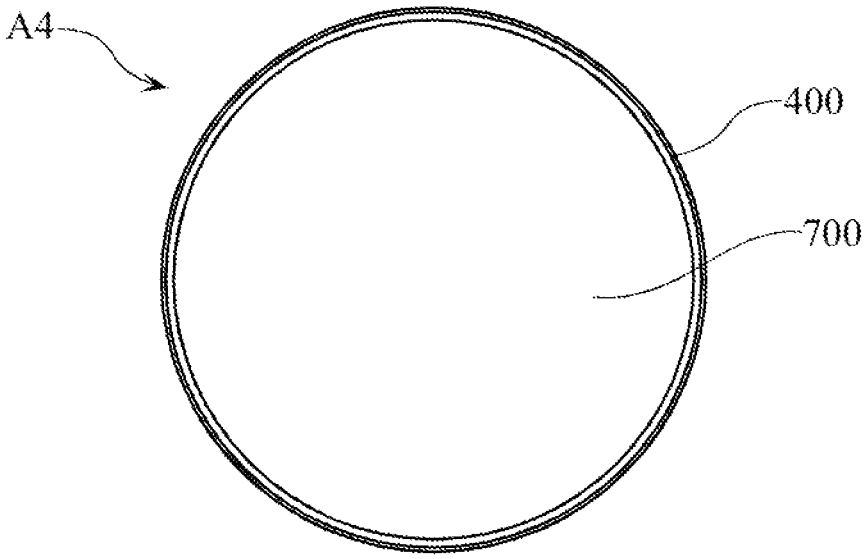
FIG. 15 is a plan view of the LED lamp shown in FIG. 9.
Figure 16:
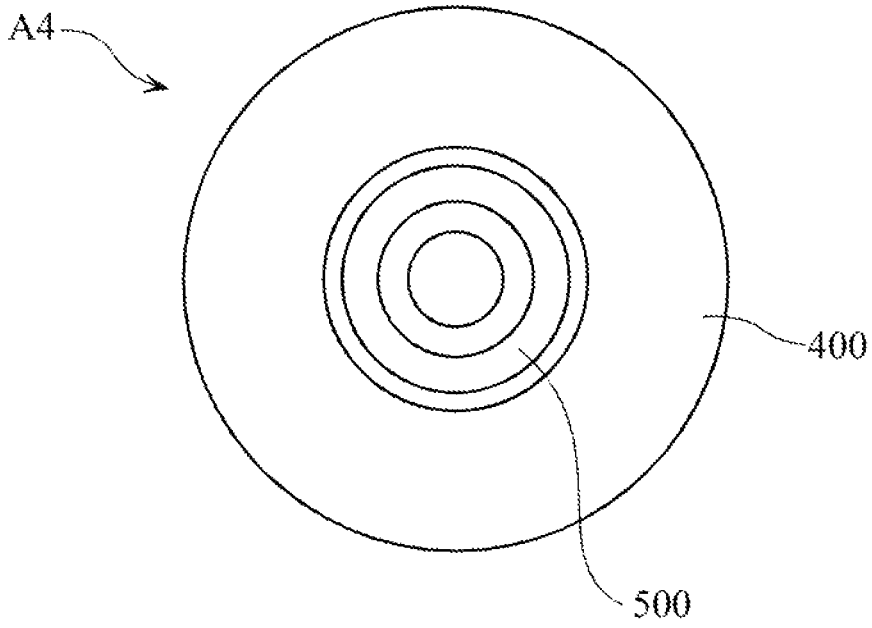
FIG. 16 is a bottom view of the LED lamp shown in FIG. 9.

A fourth embodiment of the present invention is described below with reference to FIGS. 9-19. FIG. 9 is a front view of the LED lamp according to the present embodiment. FIG. 10 is an exploded perspective view of the LED lamp according to the present embodiment. FIG. 11 is a sectional view of the LED lamp according to the present embodiment. FIG. 12 is a right side view of the LED lamp according to the present embodiment. FIG. 13 is a left side view of the LED lamp according to the present embodiment. FIG. 14 is a rear view of the LED lamp according to the present embodiment. FIG. 15 is a plan view of the LED lamp according to the present embodiment. FIG. 16 is a bottom view of the LED lamp according to the present embodiment.

The LED lamp A4 shown in these figures includes LED modules 100, a retainer 200, a support 300, a foundation portion 400, a base 500, wirings 610, 620, a globe 700 and a power source unit 800. The base 500 of the LED lamp A4 is attachable to an existing screw-type bulb socket so that the LED lamp A4 can be used as a substitute for an incandescent lamp.

Each LED module 100 incorporates an LED element that may have a laminated structure made up of an n-type semiconductor layer, a p-type semiconductor layer, and an active layer sandwiched between these semiconductor layers.

Figure 17:
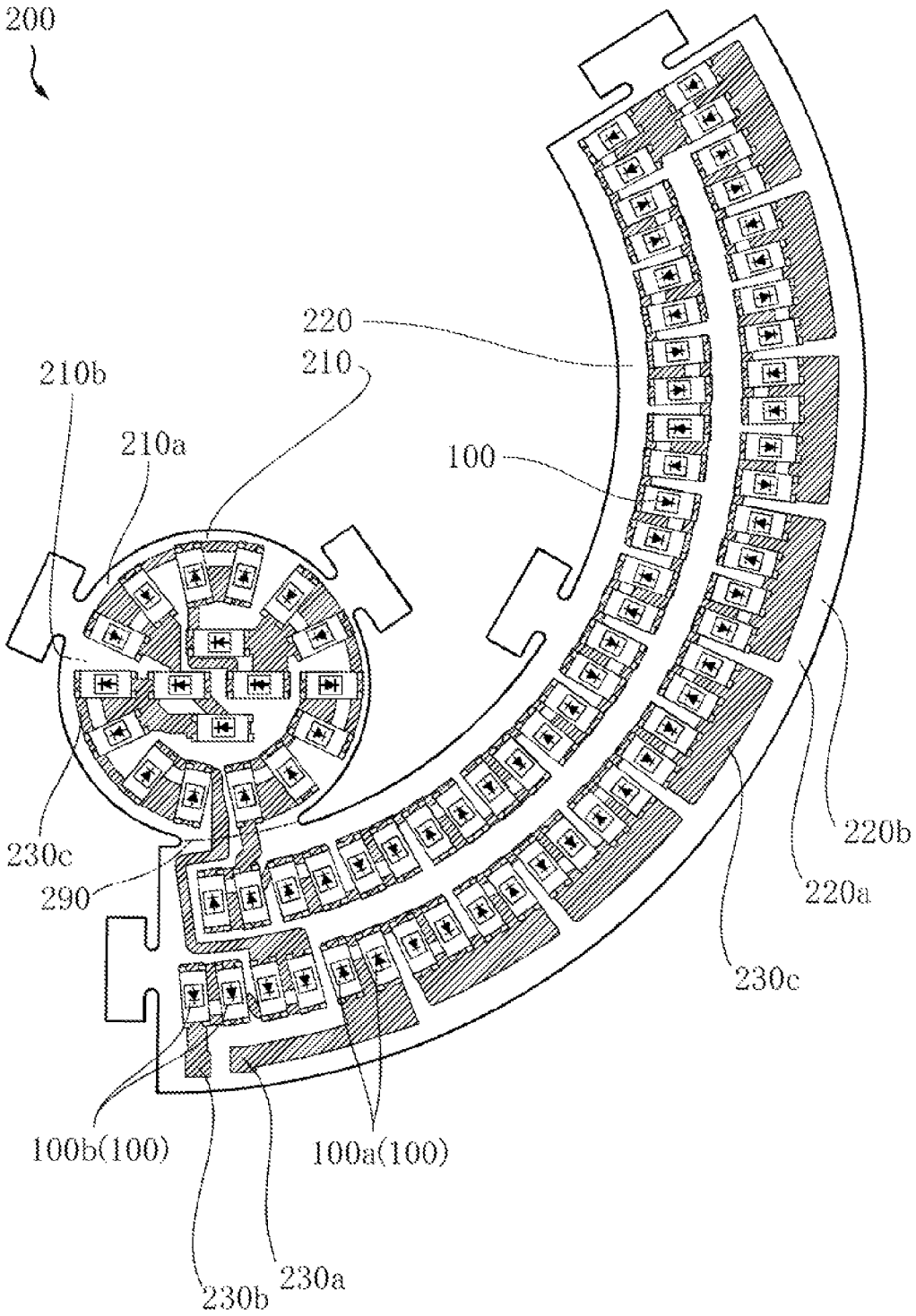
FIG. 17 is a development view of a retainer of the LED lamp shown in FIG. 9.

FIG. 17 is a development view of the retainer 200. For the convenience of understanding, the number of LED modules 100 shown in this figure is smaller than the number of LED modules 100 shown in FIG. 10, and the specific arrangement shown in this figure is slightly different from that shown in FIG. 10. In this embodiment, the retainer 200 is a flexible wiring substrate. The retainer 200 includes a top substrate 210, a side substrate 220, electrode pads 230*a*, 230*b*, and a wiring pattern 230*c*. The top substrate 210 is circular and has an obverse surface 210*a* and a reverse surface 210*b*. On the obverse surface 210*a* are mounted the LED modules 100. The side substrate 220 is in the form of a side surface of a frustum and has an obverse surface 220*a* and a reverse surface 220*b*. On the obverse surface 220*a* are mounted the LED modules 100. The electrode pads 230*a* and 230*b* are formed on the obverse surface 220*a* of the side substrate 220. The wiring pattern 230*c* is formed on the obverse surface 210*a* of the top substrate 210 and the obverse surface 220*a* of the side substrate 220.

The obverse surface 210*a* of the top substrate 210 is a central mount surface of the present invention. The obverse surface 220*a* of the side substrate 220 is a side mount surface of the present invention.

Figure 18:
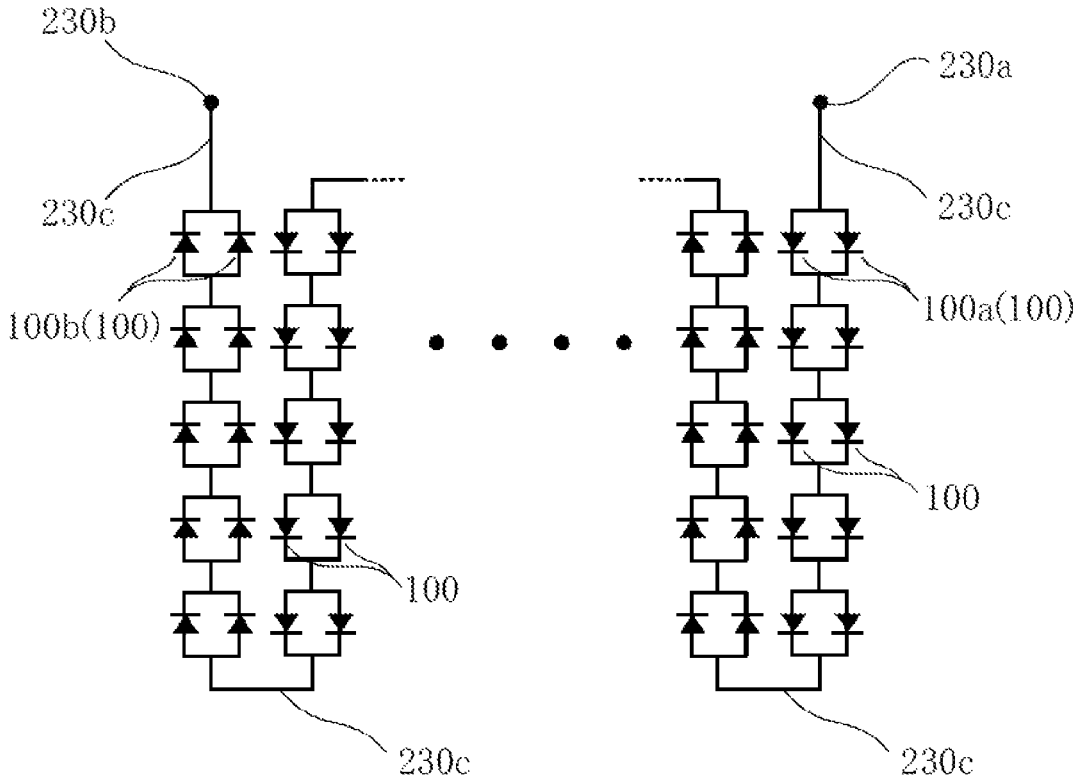
FIG. 18 shows the circuit configuration of the LED lamp shown in FIG. 9.

FIG. 18 shows the circuit configuration of the LED lamp according to the present embodiment. As shown in FIGS. 17 and 18, the wiring pattern 230*c* electrically connects the LED modules 100 to each other. Further, the wiring pattern 230*c* electrically connects two of the LED modules 100 to the electrode pad 230*a*. In these figures, the LED modules 100 electrically connected to the electrode pad 230*a* are designated as LED modules 100*a*. Further, the wiring pattern 230*c* electrically connects two of the LED modules 100 to the electrode pad 230*b*. In these figures, the LED modules 100 electrically connected to the electrode pad 230*b* are designated as LED modules 100*b*. As clearly shown in FIG. 18, in the LED lamp A4, a plurality of pairs of parallel-connected LED modules 100 are connected in series from the electrode pad 230*a* to the electrode pad 230*b*.

Figure 19:
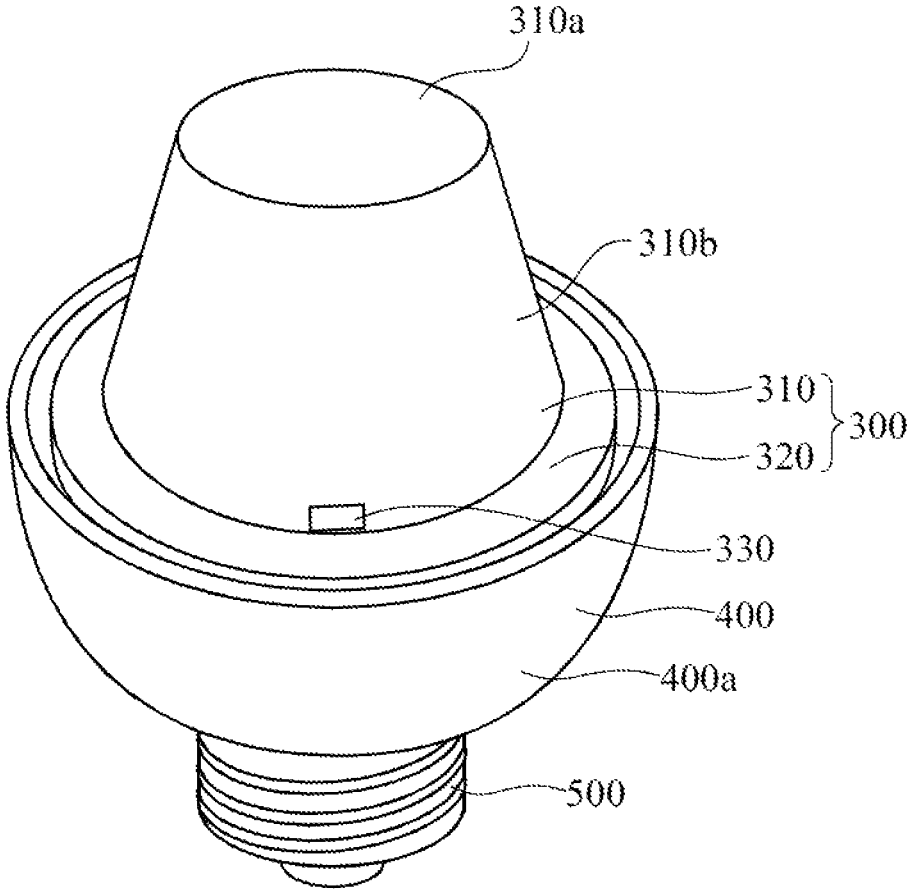
FIG. 19 is a perspective view of principal portions of the LED lamp shown in FIG. 10.

FIG. 19 is a perspective view of principal portions of the LED lamp A4 shown in FIG. 10, and specifically, shows the support 300, the foundation portion 400, and the base 500 only. As shown in FIGS. 10, 11 and 18, the support 300 includes a frustum portion 310 and a bottom plate portion 320. The support 300 is made of a material with high heat dissipation efficiency, such as aluminum. The frustum portion 310 is hollow. The frustum portion 310 includes a top surface 310*a* and a side surface 310*b*. The top surface 310*a* is a central attachment surface of the present invention and supports the top substrate 210 of the retainer 200. Specifically, the top surface 310*a* and the reverse surface 210*b* of the top substrate 210 are bonded to each other with e.g. an adhesive. On the side surface 310*b*, the side substrate 220 of the retainer 200 is placed. Specifically, the side surface 310*b* and the reverse surface 220*b* of the side substrate 220 are bonded to each other with e.g. an adhesive. In the retainer 200 in a state attached to the frustum portion 310, the boundary between the top substrate 210 and the side substrate 220 is bent to serve as a bent portion 290. The bottom plate portion 320 is a collar-like member connected to the bottom edge of the frustum portion 310. A rectangular hole 330 is formed at the boundary between the frustum portion 310 and the bottom plate portion 320.

The wiring 610 is electrically connected to the electrode pad 230*a*. The wiring 610 passes through the hole 330 and is guided into the frustum portion 310. The wiring 620 is electrically connected to the electrode pad 230*b*. The wiring 620 passes through the hole 330 and is guided into the frustum portion 310.

The foundation portion 400 supports the support 300 and hence supports the LED modules 100. The foundation portion 400 is made of e.g. aluminum. The foundation portion 400 is hollow. The outer surface 400*a* of the foundation portion 400 is a smooth surface that is not formed with a fin for heat dissipation. The outer surface 400*a* may have minute irregularities formed by embossing. When the outer surface 400*a* has such minute irregularities, the height difference among the irregularities may be e.g. 1 to 20 μm. The upper portion of the foundation portion 400 in FIG. 11 tapers as proceeding upward in FIG. 11.

As shown in FIG. 11, the globe 700 is fitted in a gap defined between the foundation portion 400 and the bottom plate portion 320. The globe 700 passes the light emitted from the LED modules 100 from the inner surface 700*a* to the outer surface 700*b*. In this embodiment, the globe 700 houses the LED modules 100 in it. The globe 700 is made of e.g. a translucent material. Examples of such a translucent material include polycarbonate. Either one or both of the inner surface 700*a* and the outer surface 700*b* may have irregularities formed by embossing. The height difference among such irregularities, when formed, may be e.g. 1 to 20 μm.

The globe 700 includes a cylindrical portion 710 and a dome portion 720. The cylindrical portion 710 tapers as proceeding upward in FIG. 11. The cylindrical portion 710 is tapered such that the outer surface 700*b* of the globe 700 is connected flush with the outer surface 400*a* of the foundation portion 400. The dome portion 720 is connected to the cylindrical portion 710. The inner surface 700*a* includes a portion where the curvature increases as proceeding upward in the figure. (That is, the inner surface 700*a* includes a portion where the radius of curvature reduces as proceeding upward in the figure.) In this embodiment, the curvature of the inner surface 700*a* changes at the boundary between the substantially flat inner surface 700*a* of the cylindrical portion 710 and the substantially spherical inner surface 700*a* of the dome portion 720.

The present invention includes the structure in which the cylindrical portion 710 is not tapered and the outer surface 700*b* of the globe 700 and the outer surface 400*a* of the foundation portion 400 are connected flush with each other.

As shown in FIG. 11, the power source unit 800 is housed in the foundation portion 400. The power source unit 800 includes an AC/DC conversion unit. Electric power is supplied from the outside of the LED lamp 4 to the power source unit 800 via the base 500. The power source unit 800 supplies electric power to the LED modules 100 via the wirings 610 and 620. Thus, light is emitted from each of the LED modules 100.

The advantages of the LED lamp A4 are described below.

In the LED lamp A4, the top substrate 210 is placed on the top surface 310*a* of the frustum portion 310, and the side substrate 220 is placed on the side surface 310*b*. The LED modules 100 are mounted on both of the obverse surface 210*a* of the top substrate 210 and the obverse surface 220*a* of the side substrate 220. Since the top surface 310*a* and the side surface 310*b* of the frustum portion 310 are oriented in different directions from each other, the direction of light emission from the LED modules 100 mounted on the obverse surface 210*a* and the direction of light emission from the LED modules 100 mounted on the obverse surface 220*a* are different from each other. Thus, the LED lamp A4 illuminates a wide area.

In the LED lamp A4, the LED modules 100 are mounted not only on the top substrate 210 but also on the side substrate 220. Thus, as compared with the conventional LED lamp X in which the LEDs 92 are mounted on a flat substrate 91, the LED lamp A4 has a larger area for mounting the LED modules 100. Thus, a larger number of LED modules 100 can be mounted in the LED lamp A4. Thus, a given luminance of light emission from the LED lamp A4 can be achieved with reduced amount of current flowing through each of the LED modules 100. Because of the characteristics of LED elements, when a current flowing through a single LED module 100 is reduced, the amount of heat generated from a single LED module 100 reduces at a greater rate than the rate of current reduction. Thus, the total amount of heat generated from the plurality of LED modules 100 reduces. Thus, the LED lamp A4 is suitable for suppressing heat generation. In the LED lamp A4, the current caused to flow to a single LED module 100 is e.g. about 25 to 30 mA. This current value is 41 to 50% of the rated current.

In the LED lamp A4, by causing current to flow between the electrode pad 230*a* and the electrode pad 230*b*, whether or not the LED modules 100 include one that cannot be turned on properly can be checked easily. By carrying out this check before attaching the retainer 200 to the support 300, the connection failure in the retainer 200 is found before the retainer 200 is attached to the support 300. Thus, according to the LED lamp A4, the retainer 200 on which an LED module 100 that cannot be turned on is mounted is prevented from being attached to the support 300. This is desirable for reducing waste in the process of manufacturing the LED lamp A4.

In the LED lamp A4, the inner surface 700*a* of the globe 700 has a portion where the curvature increases as proceeding upward in FIG. 11. Of the inner surface 700*a*, the portion close to the foundation portion 400 has a relatively small curvature. With this arrangement, a larger distance is secured between the LED modules 100 and the inner surface 700*a* than when the inner surface 700*a* is a perfectly spherical surface, for example. When the LED modules 100 are turned on and the LED lamp A4 is seen from the outer surface 700*b* side of the globe 700, the brightness is not uniform in every portion of the outer surface 700*b* if the distance between the LED modules 100 and the inner surface 700*a* is small. In the LED lamp A4, however, since a large distance is secured between the LED modules 100 and the inner surface 700*a* of the glove 700, non-uniform brightness among portions of the outer surface 700*b* is avoided.

In the present embodiment, the globe 700 is made up of the cylindrical portion 710 and the dome portion 720. This arrangement is suitable for providing a large distance between the LED modules 100 and the inner surface 700*a*. Thus, the LED lamp A4 is suitable for avoiding non-uniform brightness among portions of the outer surface 700*b*.

In the present embodiment, the LED modules 100 are housed in the globe 700. This arrangement also contributes to the achievement of uniform distance between each of the LED modules 100 and the inner surface 700*a*. This is suitable for avoiding non-uniform brightness among portions of the outer surface 700*b*.

It is to be noted that the curvature of the inner surface 700*a* of the globe 700 may change gradually as proceeding upward in FIG. 11, instead of changing at a boundary portion.

FIGS. 20-23 show a fifth embodiment of the present invention. In these figures, the elements that are identical or similar to those of the fourth embodiment are designated by the same reference signs as those used for the fourth embodiment.

Figure 20:
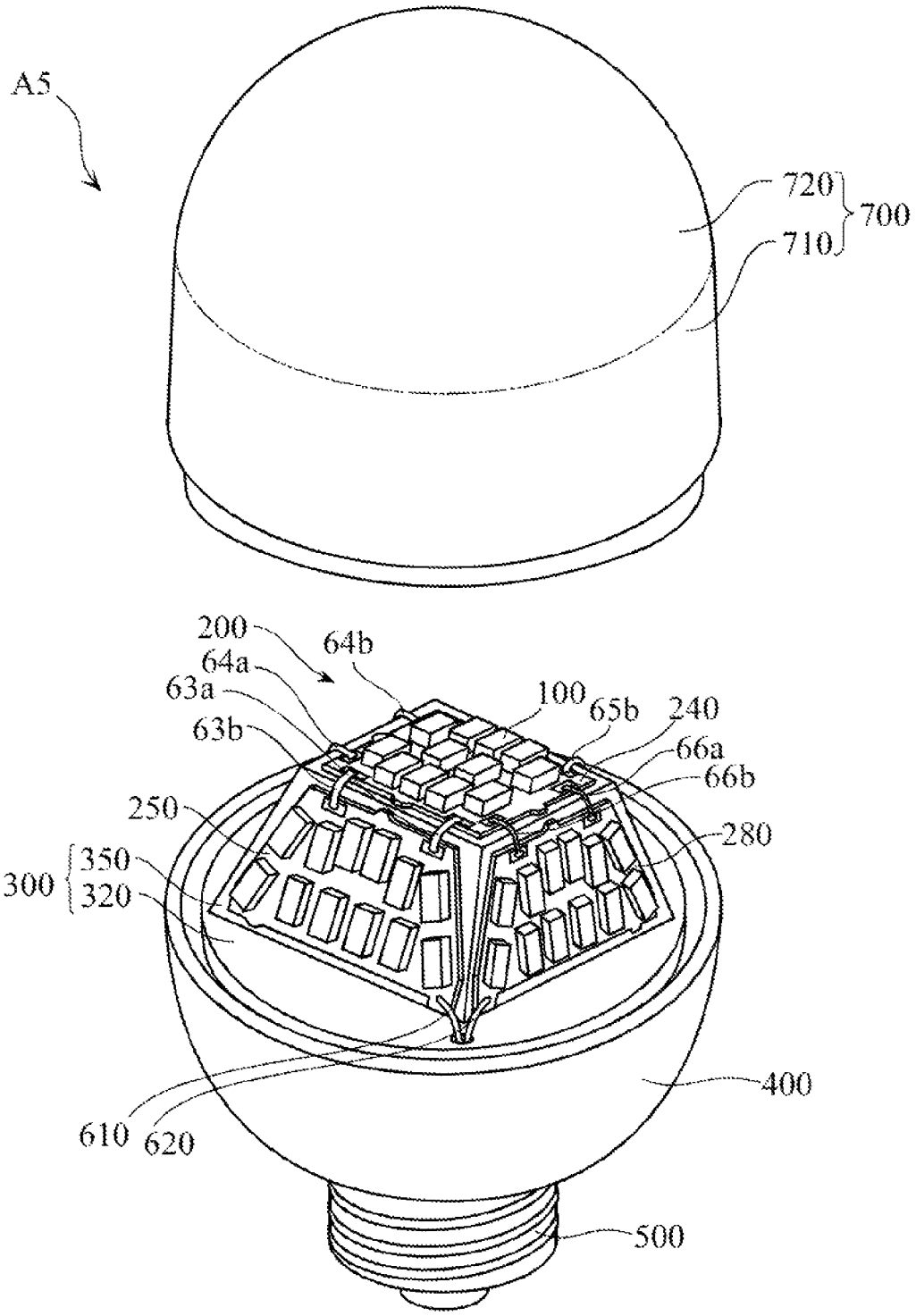
FIG. 20 is a perspective view showing an LED lamp according to a fifth embodiment of the present invention.
Figure 21:
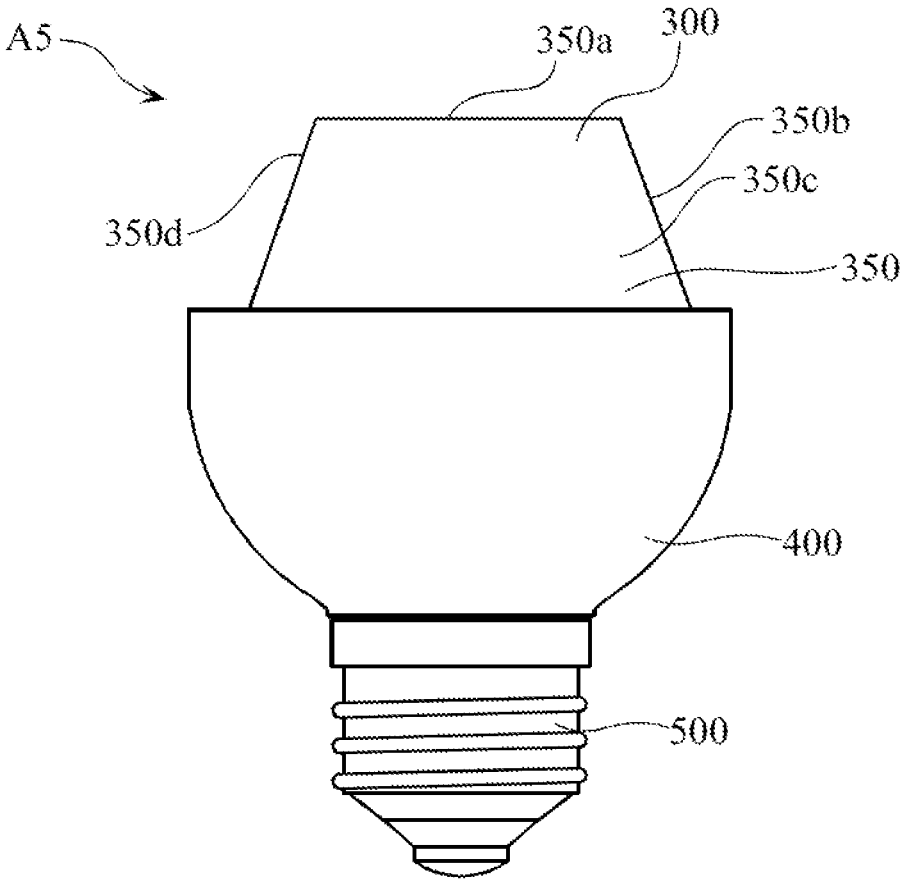
FIG. 21 is a front view showing principal portions of the LED lamp shown in FIG. 20.
Figure 22:
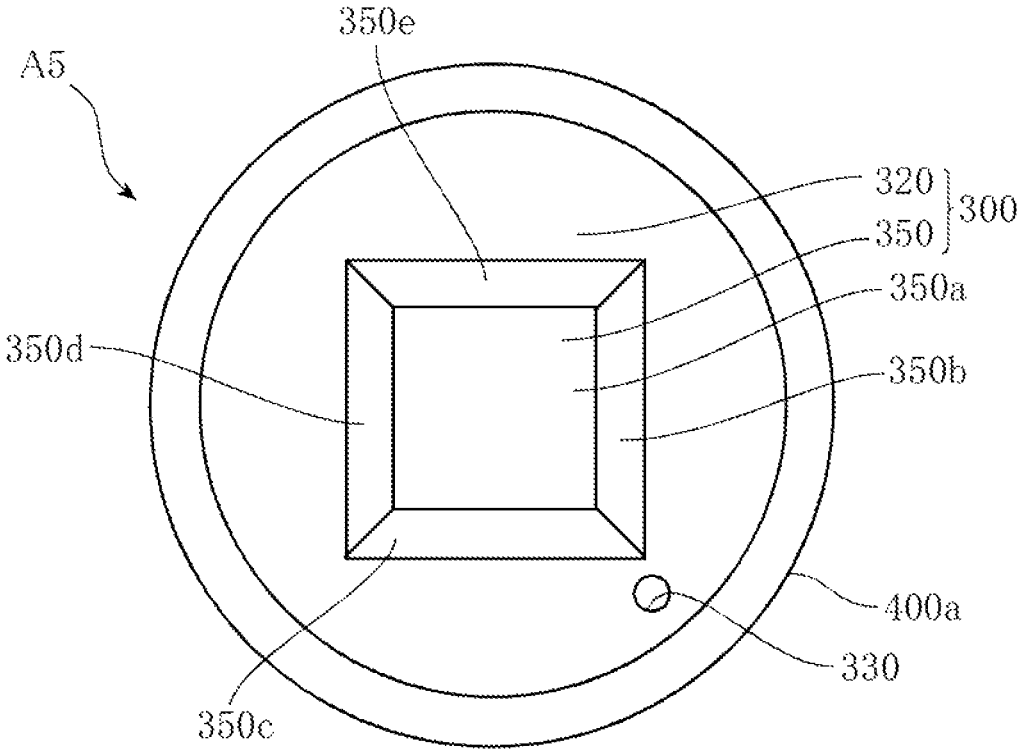
FIG. 22 is a plan view of the principal portions, as seen from above in FIG. 21.
Figure 23:
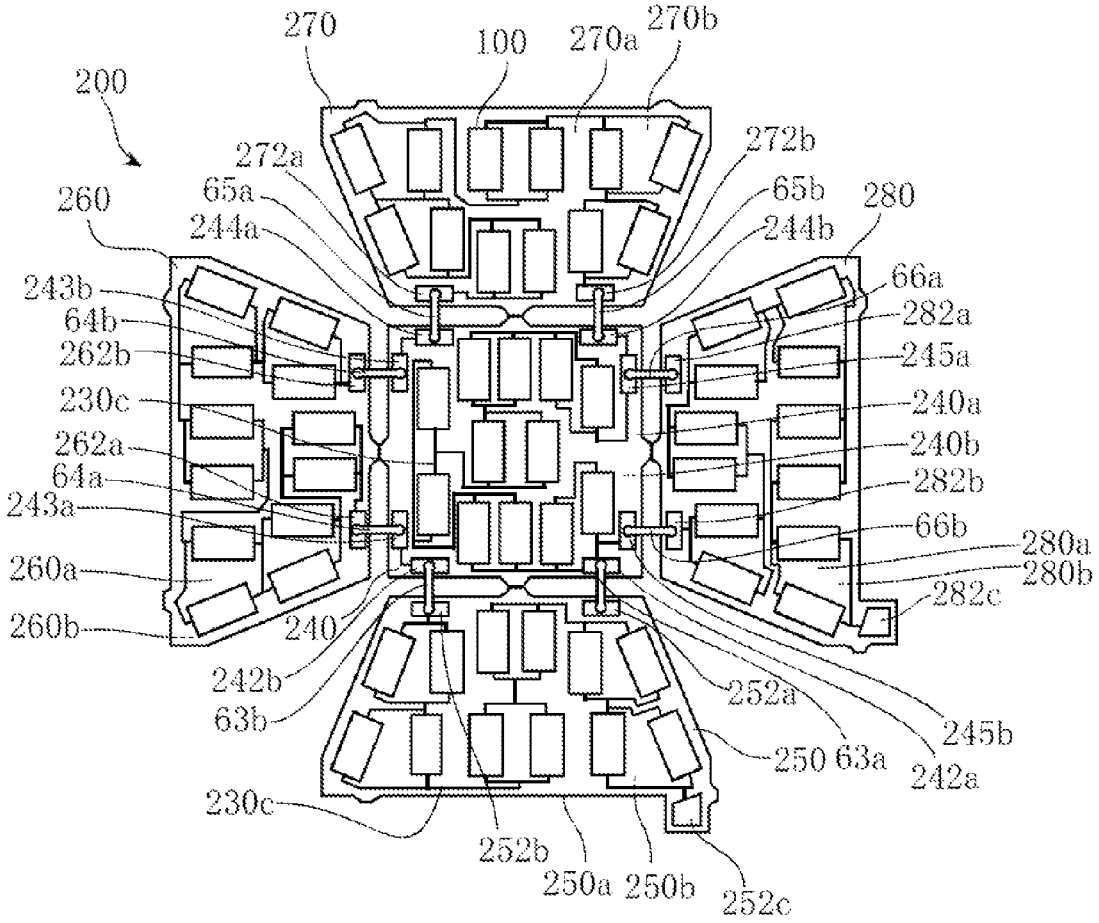
FIG. 23 is a development view of a retainer of the LED lamp shown in FIG. 20.

FIG. 20 is a perspective view showing an LED lamp according to the present embodiment. The LED lamp A5 shown in the figure includes LED modules 100, a retainer 200, a support 300, a foundation portion 400, a base 500, wirings 610, 620, eight connection members 63*a*, 63*b*, 64*a*, 64*b*, 65*a*, 65*b*, 66*a*, 66*b*, a globe 700 and a power source unit incorporated in the foundation portion 400. The LED lamp A5 is different from the LED lamp A4 mainly in the arrangement of the LED modules 100, in that the retainer 200 is made up of a plurality of plate-like substrates made of a glass-fiber-reinforced epoxy resin, and in that the support 300 is in the form of a truncated pyramid. The specific structures of the foundation portion 400, the base 500, the globe 700, and the power source unit of the LED lamp A5 are the same as those of the LED lamp A4, so that description of these parts are omitted. FIG. 21 is a front view of principal portions of the LED lamp A5 shown in FIG. 20, and specifically shows the support 300, the foundation portion 400, and the base 500 only. FIG. 22 is a plan view of the principal portions, as seen from above in FIG. 21. FIG. 23 is a development view of the retainer 200.

As shown in FIGS. 20 and 23, the retainer 200 includes a central substrate 240, peripheral substrates 250, 260, 270, 280, eight electrode pads 242*a*, 242*b*, 243*a*, 243*b*, 244*a*, 244*b*, 245*a*, 245*b*, three electrode pads 252*a*, 252*b*, 252*c*, two electrode pads 262*a*, 262*b*, two electrode pads 272*a*, 272*b*, three electrode pads 282*a*, 282*b*, 282*c* and a wiring pattern 230*c*.

The central substrate 240 is rectangular and made of e.g. glass-fiber-reinforced epoxy resin. The central substrate 240 includes an obverse surface 240*a* and a reverse surface 240*b*. On the obverse surface 240*a* are mounted twelve LED modules 100. The eight electrode pads 242*a*, 242*b*, 243*a*, 243*b*, 244*a*, 244*b*, 295*a*, 245*b* and the wiring pattern 230*c* are formed on the obverse surface 240*a*. The wiring pattern 230*c* electrically connects the electrode pad 242*a* and the electrode pad 245*b* to each other, the electrode pad 242*b* and the electrode pad 243*a* to each other, the electrode pad 243*b* and the electrode pad 244*a* to each other, and the electrode pad 244*b* and the electrode pad 245*a* to each other. The wiring pattern 230*c* on the central substrate 240 allows current to flow from the electrode pad 244*b* to the electrode pad 245*b* through the twelve LED modules 100. The wiring pattern 230*c* on the central substrate 240 connects six pairs of parallel-connected LED modules 100 in series.

The peripheral substrate 250 has a trapezoidal shape and is made of e.g. glass-fiber-reinforced epoxy resin. The peripheral substrate 250 has an obverse surface 250*a* and a reverse surface 250*b*. On the obverse surface 250*a* are mounted twelve LED modules 100. The three electrode pads 252*a*,

252*b*, 252*c* and the wiring pattern 230*c* are formed on the obverse surface 250*a*. Specifically, the electrode pads 252*a* and 252*b* are formed on the obverse surface 250*a* at a portion close to the central substrate 240. The electrode pad 252*c* is formed at an end of a side that is farther from the central substrate 240. The wiring pattern 230*c* on the peripheral substrate 250 allows current to flow from the electrode pad 252*c* to the electrode pad 252*b* through the twelve LED modules 100. The wiring pattern 230*c* on the peripheral substrate 250 connects six pairs of parallel-connected LED modules 100 in series.

The peripheral substrate 260 has a trapezoidal shape and is made of e.g. glass-fiber-reinforced epoxy resin. The peripheral substrate 260 has an obverse surface 260*a* and a reverse surface 260*b*. On the obverse surface 260*a* are mounted twelve LED modules 100. The two electrode pads 262*a*, 262*b* and the wiring pattern 230*c* are formed on the obverse surface 260*a*. Specifically, the electrode pads 262*a* and 262*b* are formed on the obverse surface 260*a* at a portion close to the central substrate 240. The wiring pattern 230*c* on the peripheral substrate 260 allows current to flow from the electrode pad 262*a* to the electrode pad 262*b* through the twelve LED modules 100. The wiring pattern 230*c* on the peripheral substrate 260 connects six pairs of parallel-connected LED modules 100 in series.

The peripheral substrate 270 has a trapezoidal shape and is made of e.g. glass-fiber-reinforced epoxy resin. The peripheral substrate 270 has an obverse surface 270*a* and a reverse surface 270*b*. On the obverse surface 270*a* are mounted twelve LED modules 100. The two electrode pads 272*a*, 272*b* and the wiring pattern 230*c* are formed on the obverse surface 270*a*. Specifically, the electrode pads 272*a* and 272*b* are formed on the obverse surface 270*a* at a portion close to the central substrate 240. The wiring pattern 230*c* on the peripheral substrate 270 allows current to flow from the electrode pad 272*a* to the electrode pad 272*b* through the twelve LED modules 100. The wiring pattern 230*c* on the peripheral substrate 270 connects six pairs of parallel-connected LED modules 100 in series.

The peripheral substrate 280 has a trapezoidal shape and is made of e.g. glass-fiber-reinforced epoxy resin. The peripheral substrate 280 has an obverse surface 280*a* and a reverse surface 280*b*. On the obverse surface 280*a* are mounted twelve LED modules 100. The three electrode pads 282*a*, 282*b*, 282*c* and the wiring pattern 230*c* are formed on the obverse surface 280*a*. Specifically, the electrode pads 282*a* and 282*b* are formed on the obverse surface 280*a* at a portion close to the central substrate 240. The electrode pad 282*c* is formed at an end of a side that is farther from the central substrate 240. The wiring pattern 230*c* on the peripheral substrate 280 allows current to flow from the electrode pad 282*b* to the electrode pad 282*c* through the twelve LED modules 100. The wiring pattern 230*c* on the peripheral substrate 280 connects six pairs of parallel-connected LED modules 100 in series.

The obverse surfaces 240*a*, 250*a*, 260*a*, 270*a* and 280*a* serve as a mount surface of the present invention.

The connection members 63*a*, 63*b*, 64*a*, 64*b*, 65*a*, 65*b*, 66*a*, 66*b* are made of e.g. solder mainly composed of Sn, Ag and Cu and bendable. The connection member 63*a* electrically connects the electrode pad 242*a* and the electrode pad 252*a*. The connection member 63*b* electrically connects the electrode pad 242*b* and the electrode pad 252*b*. The pair of connection members 63*a* and 63*b* connects the central substrate 240 and the peripheral substrate 250. It is to be noted that the electrode pad 242*a* and the electrode pad 252*a* do not need to be electrically connected to each other. However, the connection between the electrode pad 242*a* and the electrode pad 252*a* by the connection member 63*a* strengthens the joint between the central substrate 240 and the peripheral substrate 250.

The connection member 64*a* electrically connects the electrode pad 243*a* and the electrode pad 262*a*. The connection member 64*b* electrically connects the electrode pad 243*b* and the electrode pad 262*b*. The pair of connection members 64*a* and 64*b* connects the central substrate 240 and the peripheral substrate 260.

The connection member 65*a* electrically connects the electrode pad 249*a* and the electrode pad 272*a*. The connection member 65*b* electrically connects the electrode pad 244*b* and the electrode pad 272*b*. The pair of connection members 65*a* and 65*b* connects the central substrate 240 and the peripheral substrate 270.

The connection member 66*a* electrically connects the electrode pad 245*a* and the electrode pad 282*a*. The connection member 66*b* electrically connects the electrode pad 245*b* and the electrode pad 282*b*. The pair of connection members 66*a* and 66*b* connects the central substrate 240 and the peripheral substrate 280. It is to be noted that the electrode pad 245*a* and the electrode pad 282*a* do not need to be electrically connected to each other. However, the connection between the electrode pad 245*a* and the electrode pad 282*a* by the connection member 66*a* strengthens the joint between the central substrate 240 and the peripheral substrate 280.

In the LED lamp A5, current flows as follows. First, current flows from the electrode pad 252*c* to the electrode pad 252*b* through twelve LED modules 100. Then, the current flows from the electrode pad 252*b* to the electrode pad 262*a* through the connection member 63*b*, the electrode pad 242*b*, the wiring pattern 230*c*, the electrode pad 243*a* and the connection member 64*a*. Then, the current flows from the electrode pad 262*a* to the electrode pad 262*b* through twelve LED modules 100. Then, the current flows from the electrode pad 262*b* to the electrode pad 272*a* through the connection member 64*b*, the electrode pad 243*b*, the wiring pattern 230*c*, the electrode pad 244*a* and the connection member 65*a*. Then, the current flows from the electrode pad 272*a* to the electrode pad 272*b* through twelve LED modules 100. Then, the current flows from the electrode pad 272*b* to the electrode pad 245*a* through the connection member 65*b*, the electrode pad 244*b* and the wiring pattern 230*c*. Then, the current flows from the electrode pad 245*a* to the electrode pad 245*b* through twelve LED modules 100. Then, the current flows from the electrode pad 245*b* to the electrode pad 282*b* through the connection member 66*b*. Then, the current flows from the electrode pad 282*b* to the electrode pad 282*c* through twelve LED modules 100.

In the LED lamp A5, similarly to the LED lamp A4, a plurality of pairs of parallel-connected LED modules 100 are connected in series.

As shown in FIGS. 20-22, the support 300 includes a truncated pyramidal portion 350 and a bottom plate portion 320. The support 300 is made of a material with high heat dissipation efficiency, such as aluminum. The truncated pyramidal portion 350 is hollow. The truncated pyramidal portion 350 includes a top surface 350*a* and four side surfaces 350*b*, 350*c*, 350*d*, 350*e*. On the top surface 310*a* is placed the central substrate 240 of the retainer 200. Specifically, the top surface 310*a* and the reverse surface 240*b* of the central substrate 240 are bonded to each other by using e.g. a double-sided adhesive tape. On the side surface 350*b* is placed the peripheral substrate 250 of the retainer 200. Specifically, the side surface 350*b* and the reverse surface 250*b* of the peripheral substrate 250 are bonded to each other by using e.g. a double-sided adhesive tape. Similarly, on the side surface 350*c* is placed the peripheral substrate 260 of the retainer 200. On the side surface 350*d* is placed the peripheral substrate 270 of the retainer 200. On the side surface 350*e* is placed the peripheral substrate 280 of the retainer 200.

In this embodiment, the wiring 610 is connected to the electrode pad 252*c*, whereas the wiring 620 is connected to the electrode pad 282*c*.

Similarly to the LED lamp A4, the LED lamp A5 can emit light by the supply of electric power from outside of the LED lamp A5 to the LED modules 100 via the base 500.

Because of the same reasons as described above with respect to the LED lamp A4, the LED lamp A5 can illuminate a wide area. Further, similarly to the LED lamp A4, the LED lamp A5 is also suitable for suppressing heat generation.

The retainer 200 can be formed by cutting out of a single large substrate. This is desirable for enhancing the productivity of the LED lamp A5.

Figure 24:
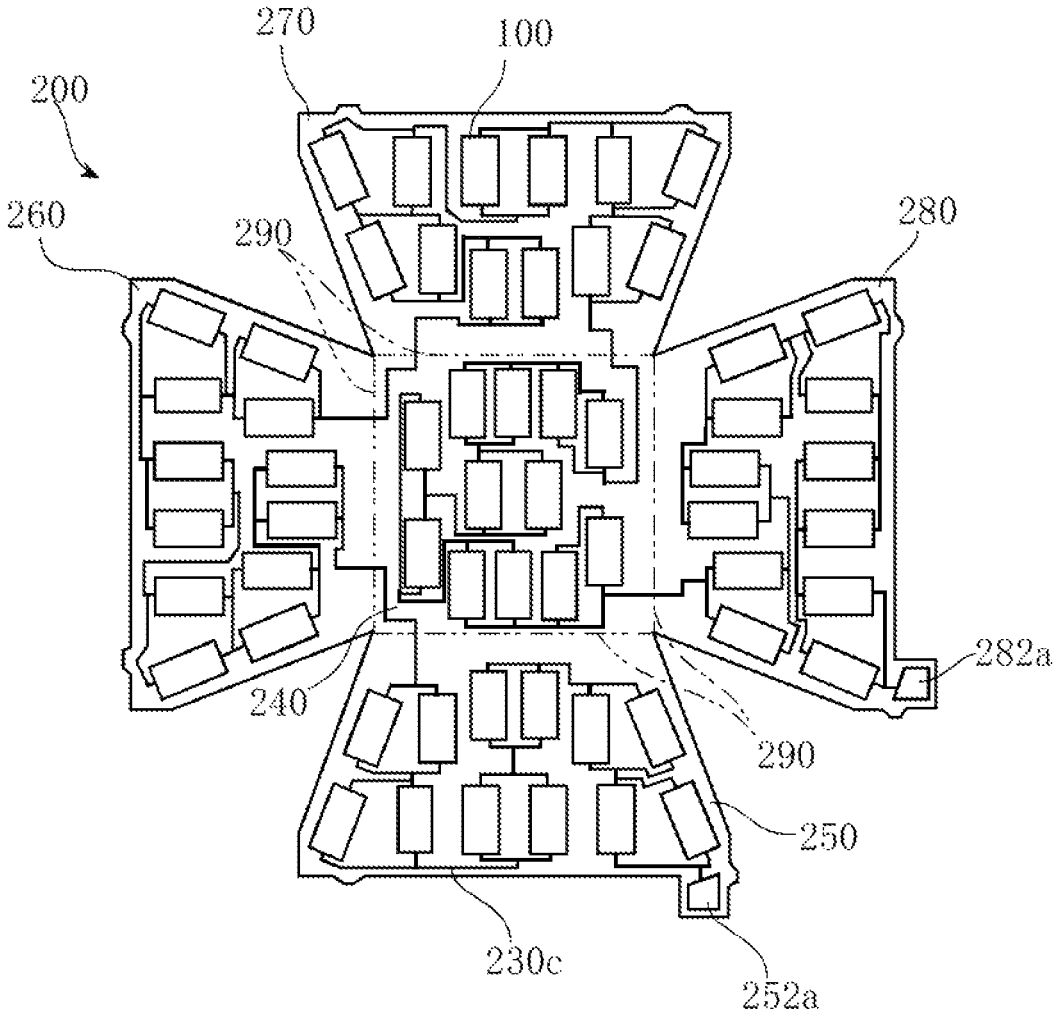
FIG. 24 is a development view of a retainer of the LED lamp according to a sixth embodiment of the present invention.
Figure 25:
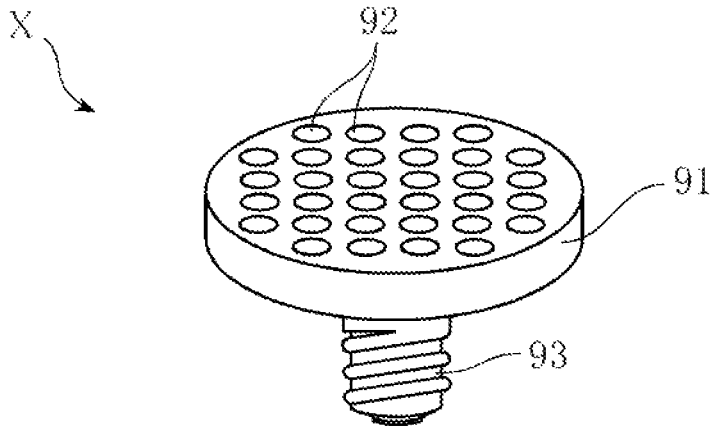
Fig.25 Prior Art
FIG. 25 is a perspective view showing an example of a conventional LED lamp.

FIG. 24 shows a sixth embodiment of the present invention. In the figure, the elements that are identical or similar to those of the fifth embodiment are designated by the same reference signs as those used for the fifth embodiment.

The LED lamp illustrated in the figure is different from the LED lamp A5 of the fifth embodiment in that a flexible substrate is employed as the retainer 200. The use of a flexible substrate as the retainer 200 eliminates the need for connecting the central substrate 240 and each of the peripheral substrates 250-280 by using a connection member, and the central substrate 240 and each of the peripheral substrates 250, 260, 270, 280 directly connect with each other. In the retainer 200 in a state placed on the support 300 shown in FIG. 20, the boundary between the central substrate 240 and each of the peripheral substrates 250-280 is bent to serve as bent portions 290.

This arrangement provides the same advantages as described above with respect to the LED lamp A4.

The LED lamp according to the present invention is not limited to the foregoing embodiments. The specific structure of each part of the LED lamp according to the present invention may be varied in design in many ways. For instance, although the LED lamp A1 for use as a substitute for an incandescent lamp is described in the embodiments, the present invention is also applicable to an LED lamp for use as a substitute for a straight-tube fluorescent lamp.

An additional LED module may be mounted on the reflective surface 47 to increase the amount of light.

The invention claimed is:

1. An LED lamp comprising:

a plurality of light emitting diodes;

a retainer on which the light emitting diodes are mounted;

a wiring pattern formed on the retainer and electrically connected to the light emitting diodes; and a current input pad and a current output pad connected to the wiring pattern;

wherein the retainer includes first and second mount surfaces that are adjacent to each other via a bent portion, and further includes a third mount surface adjacent to the second mount surface, normal line directions of the first, the second and the third mount surfaces are different from each other, the second mount surface and the third mount surface include a first corner and a second corner, respectively, the first corner and the second corner being adjacent to each other, the current input pad and the current output pad are disposed at the first corner and the second corner, respectively, and the wiring pattern is configured so that an electrical current supplied to the current input pad is caused to flow via the second mount surface, the first mount surface and the third mount surface before being outputted through the current output pad.

2. The LED lamp according to claim 1, further comprising a support including a plurality of attachment surfaces whose normal line directions are different from each other, wherein the retainer is attached to the support in such a manner that each of the first and the second mount surfaces overlaps one of the attachment surfaces.

3. The LED lamp according to claim 2, wherein the attachment surfaces include a central attachment surface that overlaps the first mount surface, the support has a shape projecting in a normal line direction of the central attachment surface, the support including a side surface that surrounds the central attachment surface as viewed in the normal line direction of the central attachment surface, and the attachment surface of the plurality of attachment surfaces that overlaps the second mount surface is provided on the side surface.

4. The LED lamp according to claim 3, wherein the side surface, as proceeding away from the central attachment surface in the normal line direction of the central attachment surface, proceeds away from the central attachment surface in a direction perpendicular to the normal line direction of the central attachment surface.

5. The LED lamp according to claim 3, wherein the central attachment surface is rectangular, and the side surface comprises a plurality of peripheral attachment surfaces that adjoin sides of the central attachment surface, respectively.

6. The LED lamp according to claim 5, wherein the retainer comprises a rectangular central substrate and a plurality of peripheral substrates separate from the central substrate and surrounding the central substrate, the first mount surface is an obverse surface of the central substrate, the second mount surface is an obverse surface of the peripheral substrates, is an obverse surface of the peripheral substrates, the bent portion comprises a pair of bendable connection members connecting the central substrate and each of the peripheral substrates, the paired connection members electrically connect the wiring pattern formed on the central substrate and the wiring pattern formed on the peripheral substrates to each other, the central substrate is attached to the central attachment surface, and the peripheral substrates are attached to the peripheral attachment surfaces.

7. The LED lamp according to claim 5, wherein the retainer comprises a flexible wiring substrate including a rectangular central mount surface that is the first mount surface and a plurality of peripheral mount surfaces that include the second mount surface and that surround the central mount surface, the bent portion is formed by bending between the peripheral mount surfaces and the central mount surface, and the retainer is attached to the support in such a manner that the central mount surface is supported by the central attachment surface and the peripheral mount surfaces are supported by the peripheral attachment surfaces.

8. The LED lamp according to claim 3, wherein the support is provided with a base for supplying electric power to the light emitting diodes, the base being positioned on an opposite side of the central attachment surface in the normal line direction of the central attachment surface.

9. The LED lamp according to claim 2, wherein the support includes a reflective surface provided around the attachment surfaces.

10. The LED lamp according to claim 9, wherein the support includes a columnar portion extending between the attachment surfaces and the reflective surface in a direction perpendicular to the reflective surface.

11. The LED lamp according to claim 2, further comprising a globe that includes an opening and houses the light emitting diodes, wherein the support is in a form of a frustum including a top surface positioned on an opposite side of the opening of the globe and a plurality of side surfaces surrounding the top surface, and the globe includes an inner surface inclined in a same direction as a direction in which said plurality of side surfaces adjacent thereto are inclined with respect to the top surface.

12. The LED lamp according to claim 1, wherein the retainer comprises a plurality of separate substrates, the first and the second mount surfaces are obverse surfaces of adjacent two of the plurality of substrates, the bent portion comprises a pair of bendable connection members connecting said two adjacent substrates, and the paired connection members electrically connect the wiring patterns formed on the two substrates to each other.

13. The LED lamp according to claim 1, wherein the retainer comprises a flexible wiring substrate, the first and the second mount surfaces are part of an obverse surface of the flexible wiring substrate, and the bent portion is formed by bending the flexible wiring substrate.

14. The LED lamp according to claim 1, further comprising a globe that includes an opening and houses the light emitting diodes.

15. The LED lamp according to claim 14, wherein an inner surface of the globe includes a portion where a radius of curvature reduces as proceeding away from the opening.

16. The LED lamp according to claim 15, wherein the globe includes a cylindrical portion and a dome portion connected to the cylindrical portion.

17. The LED lamp according to claim 16, wherein the cylindrical portion is tapered.

* * * * *